US008459380B2

(12) United States Patent
Mirchandani et al.

(10) Patent No.: US 8,459,380 B2
(45) Date of Patent: Jun. 11, 2013

(54) EARTH-BORING BITS AND OTHER PARTS INCLUDING CEMENTED CARBIDE

(75) Inventors: Prakash K. Mirchandani, Houston, TX (US); Michale E. Waller, Huntsville, AL (US); Morris E. Chandler, Santa Fe, TX (US); Heath C. Coleman, Union Grove, AL (US)

(73) Assignee: TDY Industries, LLC, Pittsburgh, PA (US)

( * ) Notice: Subject to any disclaimer, the term of this patent is extended or adjusted under 35 U.S.C. 154(b) by 0 days.

(21) Appl. No.: 13/491,638

(22) Filed: Jun. 8, 2012

(65) Prior Publication Data

US 2012/0241222 A1 Sep. 27, 2012

Related U.S. Application Data

(63) Continuation of application No. 13/207,478, filed on Aug. 11, 2011, now Pat. No. 8,225,886, which is a continuation of application No. 12/196,815, filed on Aug. 22, 2008, now Pat. No. 8,025,112.

(51) Int. Cl.
*E21B 10/46* (2006.01)

(52) U.S. Cl.
USPC ..... 175/374; 175/425; 428/614; 428/698

(58) Field of Classification Search
USPC ..... 175/374, 425; 428/614, 698
See application file for complete search history.

(56) References Cited

U.S. PATENT DOCUMENTS

| | | | |
|---|---|---|---|
| 1,509,438 | A | 9/1924 | Miller |
| 1,530,293 | A | 3/1925 | Breitenstein |
| 1,808,138 | A | 6/1931 | Hogg et al. |
| 1,811,802 | A | 6/1931 | Newman |
| 1,912,298 | A | 5/1933 | Newman |
| 2,054,028 | A | 9/1936 | Benninghoff |
| 2,093,507 | A | 9/1937 | Bartek |
| 2,093,742 | A | 9/1937 | Staples |
| 2,093,986 | A | 9/1937 | Staples |
| 2,240,840 | A | 5/1941 | Fischer |
| 2,246,237 | A | 6/1941 | Benninghoff |
| 2,283,280 | A | 5/1942 | Nell |
| 2,299,207 | A | 10/1942 | Bevillard |

(Continued)

FOREIGN PATENT DOCUMENTS

| | | |
|---|---|---|
| AU | 695583 | 2/1998 |
| CA | 1018474 A | 10/1977 |

(Continued)

OTHER PUBLICATIONS

US 4,966,627, 10/1990, Keshavan et al. (withdrawn).

(Continued)

*Primary Examiner* — Giovanna Wright
(74) *Attorney, Agent, or Firm* — K & L Gates LLP; Patrick J. Viccaro; John E. Grosselin, III

(57) ABSTRACT

An article of manufacture includes a cemented carbide piece, and a joining phase that binds the cemented carbide piece into the article. The joining phase comprises a eutectic alloy material. The article of manufacture further includes a non-cemented carbide piece bound into the article of manufacture by the joining phase. An article of manufacture includes a fixed-cutter earth-boring bit body, a roller cone, and a part for an earth-boring bit.

39 Claims, 13 Drawing Sheets

U.S. PATENT DOCUMENTS

| | | | |
|---|---|---|---|
| 2,351,827 | A | 6/1944 | McAllister |
| 2,422,994 | A | 6/1947 | Taylor |
| 2,819,958 | A | 1/1958 | Abkowitz et al. |
| 2,819,959 | A | 1/1958 | Abkowitz et al. |
| 2,906,654 | A | 9/1959 | Abkowitz |
| 2,954,570 | A | 10/1960 | Couch |
| 3,041,641 | A | 7/1962 | Hradek et al. |
| 3,093,850 | A | 6/1963 | Kelso |
| 3,368,881 | A | 2/1968 | Abkowitz et al. |
| 3,471,921 | A | 10/1969 | Feenstra |
| 3,482,295 | A | 12/1969 | Trent |
| 3,490,901 | A | 1/1970 | Hachisuka et al. |
| 3,581,835 | A | 6/1971 | Stebley |
| 3,629,887 | A | 12/1971 | Urbanic |
| 3,660,050 | A | 5/1972 | Iler et al. |
| 3,757,879 | A | 9/1973 | Wilder et al. |
| 3,762,882 | A | 10/1973 | Grutza |
| 3,776,655 | A | 12/1973 | Urbanic |
| 3,782,848 | A | 1/1974 | Pfeifer |
| 3,806,270 | A | 4/1974 | Tanner et al. |
| 3,812,548 | A | 5/1974 | Theuerkaue |
| 3,889,516 | A | 6/1975 | Yankee et al. |
| RE28,645 | E | 12/1975 | Aoki et al. |
| 3,936,295 | A | 2/1976 | Cromwell et al. |
| 3,942,954 | A | 3/1976 | Frehn |
| 3,980,549 | A | 9/1976 | Grutza |
| 3,987,859 | A | 10/1976 | Lichte |
| 4,009,027 | A | 2/1977 | Naidich et al. |
| 4,017,480 | A | 4/1977 | Baum |
| 4,047,828 | A | 9/1977 | Makely |
| 4,094,709 | A | 6/1978 | Rozmus |
| 4,097,180 | A | 6/1978 | Kwieraga |
| 4,097,275 | A | 6/1978 | Horvath |
| 4,105,049 | A | 8/1978 | Anderson |
| 4,106,382 | A | 8/1978 | Salje et al. |
| 4,126,652 | A | 11/1978 | Oohara et al. |
| 4,128,136 | A | 12/1978 | Generoux |
| 4,170,499 | A | 10/1979 | Thomas et al. |
| 4,181,505 | A | 1/1980 | De Vries et al. |
| 4,198,233 | A | 4/1980 | Frehn |
| 4,221,270 | A | 9/1980 | Vezirian |
| 4,229,638 | A | 10/1980 | Lichte |
| 4,233,720 | A | 11/1980 | Rozmus |
| 4,255,165 | A | 3/1981 | Dennis et al. |
| 4,270,952 | A | 6/1981 | Kobayashi |
| 4,276,788 | A | 7/1981 | van Nederveen |
| 4,277,106 | A | 7/1981 | Sahley |
| 4,277,108 | A | 7/1981 | Wallace |
| 4,306,139 | A | 12/1981 | Shinozaki et al. |
| 4,311,490 | A | 1/1982 | Bovenkerk et al. |
| 4,325,994 | A | 4/1982 | Kitashima et al. |
| 4,327,156 | A | 4/1982 | Dillon et al. |
| 4,331,741 | A | 5/1982 | Wilson |
| 4,340,327 | A | 7/1982 | Martins |
| 4,341,557 | A | 7/1982 | Lizenby |
| 4,351,401 | A | 9/1982 | Fielder |
| 4,376,793 | A | 3/1983 | Jackson |
| 4,389,952 | A | 6/1983 | Dreier et al. |
| 4,396,321 | A | 8/1983 | Holmes |
| 4,398,952 | A | 8/1983 | Drake |
| 4,423,646 | A | 1/1984 | Bernhardt |
| 4,478,297 | A | 10/1984 | Radtke |
| 4,497,358 | A | 2/1985 | Gnadig et al. |
| 4,499,048 | A | 2/1985 | Hanejko |
| 4,499,795 | A | 2/1985 | Radtke |
| 4,520,882 | A | 6/1985 | van Nederveen |
| 4,526,748 | A | 7/1985 | Rozmus |
| 4,547,104 | A | 10/1985 | Holmes |
| 4,547,337 | A | 10/1985 | Rozmus |
| 4,550,532 | A | 11/1985 | Fletcher, Jr. et al. |
| 4,552,232 | A | 11/1985 | Frear |
| 4,553,615 | A | 11/1985 | Grainger |
| 4,554,130 | A | 11/1985 | Ecer |
| 4,562,990 | A | 1/1986 | Rose |
| 4,574,011 | A | 3/1986 | Bonjour et al. |
| 4,579,713 | A | 4/1986 | Lueth |
| 4,587,174 | A | 5/1986 | Yoshimura et al. |
| 4,592,685 | A | 6/1986 | Beere |
| 4,596,694 | A | 6/1986 | Rozmus |
| 4,597,456 | A | 7/1986 | Ecer |
| 4,597,730 | A | 7/1986 | Rozmus |
| 4,604,106 | A | 8/1986 | Hall |
| 4,604,781 | A | 8/1986 | Rankin, III |
| 4,605,343 | A | 8/1986 | Hibbs, Jr. et al. |
| 4,609,577 | A | 9/1986 | Long |
| 4,630,693 | A | 12/1986 | Goodfellow |
| 4,642,003 | A | 2/1987 | Yoshimura |
| 4,649,086 | A | 3/1987 | Johnson |
| 4,656,002 | A | 4/1987 | Lizenby et al. |
| 4,662,461 | A | 5/1987 | Garrett |
| 4,667,756 | A | 5/1987 | King et al. |
| 4,686,080 | A | 8/1987 | Hara et al. |
| 4,686,156 | A | 8/1987 | Baldoni, II et al. |
| 4,694,919 | A | 9/1987 | Barr |
| 4,708,542 | A | 11/1987 | Emanuelli |
| 4,722,405 | A | 2/1988 | Langford |
| 4,729,789 | A | 3/1988 | Ide et al. |
| 4,743,515 | A | 5/1988 | Fischer et al. |
| 4,744,943 | A | 5/1988 | Timm |
| 4,749,053 | A | 6/1988 | Hollingshead |
| 4,752,159 | A | 6/1988 | Howlett |
| 4,752,164 | A | 6/1988 | Leonard, Jr. |
| 4,761,844 | A | 8/1988 | Turchan |
| 4,779,440 | A | 10/1988 | Cleve et al. |
| 4,780,274 | A | 10/1988 | Barr |
| 4,804,049 | A | 2/1989 | Barr |
| 4,809,903 | A | 3/1989 | Eylon et al. |
| 4,813,823 | A | 3/1989 | Bieneck |
| 4,831,674 | A | 5/1989 | Bergstrom et al. |
| 4,838,366 | A | 6/1989 | Jones |
| 4,861,350 | A | 8/1989 | Phaal et al. |
| 4,871,377 | A | 10/1989 | Frushour |
| 4,881,431 | A | 11/1989 | Bieneck |
| 4,884,477 | A | 12/1989 | Smith et al. |
| 4,889,017 | A | 12/1989 | Fuller et al. |
| 4,899,838 | A | 2/1990 | Sullivan et al. |
| 4,919,013 | A | 4/1990 | Smith et al. |
| 4,923,512 | A | 5/1990 | Timm et al. |
| 4,934,040 | A | 6/1990 | Turchan |
| 4,943,191 | A | 7/1990 | Schmidtt |
| 4,956,012 | A | 9/1990 | Jacobs et al. |
| 4,968,348 | A | 11/1990 | Abkowitz et al. |
| 4,971,485 | A | 11/1990 | Nomura et al. |
| 4,991,670 | A | 2/1991 | Fuller et al. |
| 5,000,273 | A | 3/1991 | Horton et al. |
| 5,010,945 | A | 4/1991 | Burke |
| 5,030,598 | A | 7/1991 | Hsieh |
| 5,032,352 | A | 7/1991 | Meeks et al. |
| 5,041,261 | A | 8/1991 | Buljan et al. |
| 5,049,450 | A | 9/1991 | Dorfman et al. |
| RE33,753 | E | 11/1991 | Vacchiano et al. |
| 5,067,860 | A | 11/1991 | Kobayashi et al. |
| 5,075,315 | A | 12/1991 | Rasmussen |
| 5,075,316 | A | 12/1991 | Hubele |
| 5,080,538 | A | 1/1992 | Schmidtt |
| 5,090,491 | A | 2/1992 | Tibbitts et al. |
| 5,092,412 | A | 3/1992 | Walk |
| 5,094,571 | A | 3/1992 | Ekerot |
| 5,096,465 | A | 3/1992 | Chen et al. |
| 5,098,232 | A | 3/1992 | Benson |
| 5,110,687 | A | 5/1992 | Abe et al. |
| 5,112,162 | A | 5/1992 | Hartford et al. |
| 5,112,168 | A | 5/1992 | Glimpel |
| 5,116,659 | A | 5/1992 | Glatzle et al. |
| 5,126,206 | A | 6/1992 | Garg et al. |
| 5,127,776 | A | 7/1992 | Glimpel |
| 5,135,801 | A | 8/1992 | Nyström et al. |
| 5,161,898 | A | 11/1992 | Drake |
| 5,174,700 | A | 12/1992 | Sgarbi et al. |
| 5,179,772 | A | 1/1993 | Braun et al. |
| 5,186,739 | A | 2/1993 | Isobe et al. |
| 5,203,513 | A | 4/1993 | Keller et al. |
| 5,203,932 | A | 4/1993 | Kato et al. |
| 5,217,081 | A | 6/1993 | Waldenström et al. |
| 5,232,522 | A | 8/1993 | Doktycz et al. |
| 5,250,355 | A | 10/1993 | Newman et al. |
| 5,266,415 | A | 11/1993 | Newkirk et al. |

5,273,380 A 12/1993 Musacchia
5,281,260 A 1/1994 Kumar et al.
5,286,685 A 2/1994 Schoennahl et al.
5,305,840 A 4/1994 Liang et al.
5,311,958 A 5/1994 Isbell et al.
5,326,196 A 7/1994 Noll
5,333,520 A 8/1994 Fischer et al.
5,335,738 A 8/1994 Waldenström et al.
5,338,135 A 8/1994 Noguchi et al.
5,346,316 A 9/1994 Okada et al.
5,348,806 A 9/1994 Kojo et al.
5,354,155 A 10/1994 Adams
5,359,772 A 11/1994 Carlsson et al.
5,373,907 A 12/1994 Weaver
5,376,329 A 12/1994 Morgan et al.
5,413,438 A 5/1995 Turchan
5,423,899 A 6/1995 Krall et al.
5,429,459 A 7/1995 Palm
5,433,280 A 7/1995 Smith
5,438,108 A 8/1995 Umemura et al.
5,438,858 A 8/1995 Friedrichs
5,443,337 A 8/1995 Katayama
5,447,549 A 9/1995 Yoshimura
5,452,771 A 9/1995 Blackman et al.
5,467,669 A 11/1995 Stroud
5,474,407 A 12/1995 Rodel et al.
5,479,997 A 1/1996 Scott et al.
5,480,272 A 1/1996 Jorgensen et al.
5,482,670 A 1/1996 Hong
5,484,468 A 1/1996 Östlund et al.
5,487,626 A 1/1996 Von Holst et al.
5,492,186 A 2/1996 Overstreet et al.
5,496,137 A 3/1996 Ochayon et al.
5,498,142 A 3/1996 Mills
5,505,748 A 4/1996 Tank et al.
5,506,055 A 4/1996 Dorfman et al.
5,518,077 A 5/1996 Blackman et al.
5,525,134 A 6/1996 Mehrotra et al.
5,541,006 A 7/1996 Conley
5,543,235 A 8/1996 Mirchandani et al.
5,544,550 A 8/1996 Smith
5,560,238 A 10/1996 Allebach et al.
5,560,440 A 10/1996 Tibbitts
5,570,978 A 11/1996 Rees et al.
5,580,666 A 12/1996 Dubensky et al.
5,586,612 A 12/1996 Isbell et al.
5,590,729 A 1/1997 Cooley et al.
5,593,474 A 1/1997 Keshavan et al.
5,601,857 A 2/1997 Friedrichs
5,603,075 A 2/1997 Stoll et al.
5,609,286 A 3/1997 Anthon
5,609,447 A 3/1997 Britzke et al.
5,611,251 A 3/1997 Katayama
5,612,264 A 3/1997 Nilsson et al.
5,628,837 A 5/1997 Britzke et al.
RE35,538 E 6/1997 Akesson et al.
5,641,251 A 6/1997 Leins et al.
5,641,921 A 6/1997 Dennis et al.
5,662,183 A 9/1997 Fang
5,666,864 A 9/1997 Tibbitts
5,672,382 A 9/1997 Lux
5,677,042 A 10/1997 Massa et al.
5,679,445 A 10/1997 Massa et al.
5,686,119 A 11/1997 McNaughton, Jr.
5,697,042 A 12/1997 Massa et al.
5,697,046 A 12/1997 Conley
5,697,462 A 12/1997 Grimes et al.
5,704,736 A 1/1998 Giannetti
5,712,030 A 1/1998 Goto et al.
5,718,948 A 2/1998 Ederyd et al.
5,732,783 A 3/1998 Truax et al.
5,733,078 A 3/1998 Matsushita et al.
5,733,649 A 3/1998 Kelley et al.
5,733,664 A 3/1998 Kelley et al.
5,750,247 A 5/1998 Bryant et al.
5,753,160 A 5/1998 Takeuchi et al.
5,755,033 A 5/1998 Gunter et al.
5,755,298 A 5/1998 Langford, Jr. et al.
5,762,843 A 6/1998 Massa et al.
5,765,095 A 6/1998 Flak et al.
5,776,593 A 7/1998 Massa et al.
5,778,301 A 7/1998 Hong
5,789,686 A 8/1998 Massa et al.
5,791,833 A 8/1998 Niebauer
5,792,403 A 8/1998 Massa et al.
5,803,152 A 9/1998 Dolman et al.
5,806,934 A 9/1998 Massa et al.
5,830,256 A 11/1998 Northrop et al.
5,851,094 A 12/1998 Strand et al.
5,856,626 A 1/1999 Fischer et al.
5,865,571 A 2/1999 Tankala et al.
5,873,684 A 2/1999 Flolo
5,880,382 A 3/1999 Fang et al.
5,890,852 A 4/1999 Gress
5,893,204 A 4/1999 Symonds
5,897,830 A 4/1999 Abkowitz et al.
5,899,257 A 5/1999 Alleweireldt et al.
5,947,660 A 9/1999 Karlsson et al.
5,957,006 A 9/1999 Smith
5,963,775 A 10/1999 Fang
5,964,555 A 10/1999 Strand
5,967,249 A 10/1999 Butcher
5,971,670 A 10/1999 Pantzar et al.
5,976,707 A 11/1999 Grab et al.
5,988,953 A 11/1999 Berglund et al.
6,007,909 A 12/1999 Rolander et al.
6,012,882 A 1/2000 Turchan
6,022,175 A 2/2000 Heinrich et al.
6,029,544 A 2/2000 Katayama
6,051,171 A 4/2000 Takeuchi et al.
6,063,333 A 5/2000 Dennis
6,068,070 A 5/2000 Scott
6,073,518 A 6/2000 Chow et al.
6,076,999 A 6/2000 Hedberg et al.
6,086,003 A 7/2000 Gunter et al.
6,086,980 A 7/2000 Foster et al.
6,089,123 A 7/2000 Chow et al.
6,109,377 A 8/2000 Massa et al.
6,109,677 A 8/2000 Anthony
6,117,493 A 9/2000 North
6,135,218 A 10/2000 Deane et al.
6,148,936 A 11/2000 Evans et al.
6,200,514 B1 3/2001 Meister
6,209,420 B1 4/2001 Butcher et al.
6,214,134 B1 4/2001 Eylon et al.
6,214,287 B1 4/2001 Waldenström
6,220,117 B1 4/2001 Butcher
6,227,188 B1 5/2001 Tankala et al.
6,228,139 B1 5/2001 Oskarsson
6,234,261 B1 5/2001 Evans et al.
6,241,036 B1 6/2001 Lovato et al.
6,248,277 B1 6/2001 Friedrichs
6,254,658 B1 7/2001 Taniuchi et al.
6,287,360 B1 9/2001 Kembaiyan et al.
6,290,438 B1 9/2001 Papajewski
6,293,986 B1 9/2001 Rödiger et al.
6,299,658 B1 10/2001 Moriguchi et al.
6,302,224 B1 10/2001 Sherwood, Jr.
6,326,582 B1 12/2001 North
6,345,941 B1 2/2002 Fang et al.
6,353,771 B1 3/2002 Southland
6,372,346 B1 4/2002 Toth
6,374,932 B1 4/2002 Brady
6,375,706 B2 4/2002 Kembaiyan et al.
6,386,954 B2 5/2002 Sawabe et al.
6,395,108 B2 5/2002 Eberle et al.
6,402,439 B1 6/2002 Puide et al.
6,425,716 B1 7/2002 Cook
6,450,739 B1 9/2002 Puide et al.
6,453,899 B1 9/2002 Tselesin
6,454,025 B1 9/2002 Runquist et al.
6,454,028 B1 9/2002 Evans
6,454,030 B1 9/2002 Findley et al.
6,458,471 B2 10/2002 Lovato et al.
6,461,401 B1 10/2002 Kembaiyan et al.
6,474,425 B1 11/2002 Truax et al.
6,475,647 B1 11/2002 Mendez Acevedo et al.
6,499,917 B1 12/2002 Parker et al.

6,499,920 B2 12/2002 Sawabe
6,500,226 B1 12/2002 Dennis
6,502,623 B1 1/2003 Schmitt
6,511,265 B1 1/2003 Mirchandani et al.
6,544,308 B2 4/2003 Griffin et al.
6,546,991 B2 4/2003 Dworog et al.
6,551,035 B1 4/2003 Bruhn et al.
6,562,462 B2 5/2003 Griffin et al.
6,576,182 B1 6/2003 Ravagni et al.
6,582,126 B2 6/2003 North
6,585,064 B2 7/2003 Griffin et al.
6,585,864 B1 7/2003 Fisher et al.
6,589,640 B2 7/2003 Griffin et al.
6,599,467 B1 7/2003 Yamaguchi et al.
6,607,693 B1 8/2003 Saito et al.
6,607,835 B2 8/2003 Fang et al.
6,637,528 B2 10/2003 Nishiyama et al.
6,648,068 B2 11/2003 Dewey et al.
6,649,682 B1 11/2003 Breton et al.
6,651,757 B2 11/2003 Belnap et al.
6,655,481 B2 12/2003 Findley et al.
6,655,882 B2 12/2003 Heinrich et al.
6,676,863 B2 1/2004 Christiaens et al.
6,682,780 B2 1/2004 Tzatzov et al.
6,685,880 B2 2/2004 Engström et al.
6,688,988 B2 2/2004 McClure
6,695,551 B2 2/2004 Silver
6,706,327 B2 3/2004 Blomstedt et al.
6,716,388 B2 4/2004 Bruhn et al.
6,719,074 B2 4/2004 Tsuda et al.
6,725,953 B2 4/2004 Truax et al.
6,737,178 B2 5/2004 Ota et al.
6,742,608 B2 6/2004 Murdoch
6,742,611 B1 6/2004 Illerhaus et al.
6,756,009 B2 6/2004 Sim et al.
6,764,555 B2 7/2004 Hiramatsu et al.
6,766,870 B2 7/2004 Overstreet
6,767,505 B2 7/2004 Witherspoon et al.
6,772,849 B2 8/2004 Oldham et al.
6,782,958 B2 8/2004 Liang et al.
6,799,648 B2 10/2004 Brandenberg et al.
6,808,821 B2 10/2004 Fujita et al.
6,844,085 B2 1/2005 Takayama et al.
6,848,521 B2 2/2005 Lockstedt et al.
6,849,231 B2 2/2005 Kojima et al.
6,892,793 B2 5/2005 Liu et al.
6,899,495 B2 5/2005 Hansson et al.
6,918,942 B2 7/2005 Hatta et al.
6,932,172 B2 8/2005 Dvorachek
6,933,049 B2 8/2005 Wan et al.
6,948,890 B2 9/2005 Svensson et al.
6,949,148 B2 9/2005 Sugiyama et al.
6,955,233 B2 10/2005 Crowe et al.
6,958,099 B2 10/2005 Nakamura et al.
7,014,719 B2 3/2006 Suzuki et al.
7,014,720 B2 3/2006 Iseda
7,017,677 B2 3/2006 Keshavan et al.
7,036,611 B2 5/2006 Radford et al.
7,044,243 B2 5/2006 Kembaiyan et al.
7,048,081 B2 5/2006 Smith et al.
7,070,666 B2 7/2006 Druschitz et al.
7,080,998 B2 7/2006 Hall et al.
7,090,731 B2 8/2006 Kashima et al.
7,101,128 B2 9/2006 Hansson
7,101,446 B2 9/2006 Takeda et al.
7,112,143 B2 9/2006 Muller
7,125,207 B2 10/2006 Craig et al.
7,128,773 B2 10/2006 Liang et al.
7,147,413 B2 12/2006 Henderer et al.
7,152,701 B2 12/2006 Butland et al.
7,175,404 B2 2/2007 Kondo et al.
7,192,660 B2 3/2007 Ruppi
7,207,401 B2 4/2007 Dewey et al.
7,207,750 B2 4/2007 Annanolli et al.
7,216,727 B2 5/2007 Wardley
7,231,984 B2 6/2007 Jaensch
7,234,541 B2 6/2007 Scott et al.
7,234,550 B2 6/2007 Azar et al.
7,235,211 B2 6/2007 Griffo et al.
7,238,414 B2 7/2007 Benitsch et al.
7,244,519 B2 7/2007 Festeau et al.
7,250,069 B2 7/2007 Kembaiyan et al.
7,261,782 B2 8/2007 Hwang et al.
7,267,187 B2 9/2007 Kembaiyan
7,267,543 B2 9/2007 Freidhoff et al.
7,270,679 B2 9/2007 Istephanous et al.
7,296,497 B2 11/2007 Kugelberg et al.
7,350,599 B2 4/2008 Lockwood et al.
7,381,283 B2 6/2008 Lee et al.
7,384,413 B2 6/2008 Gross et al.
7,384,443 B2 6/2008 Mirchandani et al.
7,395,882 B2 7/2008 Oldham et al.
7,410,610 B2 8/2008 Woodfield et al.
7,487,849 B2 2/2009 Radtke
7,497,280 B2 3/2009 Brackin et al.
7,497,396 B2 3/2009 Splinter et al.
7,513,320 B2 4/2009 Mirchandani et al.
7,524,351 B2 4/2009 Hua et al.
7,556,668 B2 7/2009 Eason et al.
7,575,620 B2 8/2009 Terry et al.
7,625,157 B2 12/2009 Prichard et al.
7,632,323 B2 12/2009 Ganguly et al.
7,661,491 B2 2/2010 Kembaiyan et al.
7,687,156 B2 3/2010 Fang
7,703,555 B2 4/2010 Overstreet
7,810,588 B2 10/2010 McClain et al.
7,832,456 B2 11/2010 Calnan et al.
7,832,457 B2 11/2010 Calnan et al.
7,846,551 B2 12/2010 Fang et al.
7,887,747 B2 2/2011 Iwasaki et al.
7,954,569 B2 6/2011 Mirchandani et al.
8,007,714 B2 8/2011 Mirchandani et al.
8,007,922 B2 8/2011 Mirchandani et al.
8,025,112 B2 9/2011 Mirchandani et al.
8,087,324 B2 1/2012 Mirchandani et al.
8,109,177 B2 2/2012 Kembaiyan et al.
8,137,816 B2 3/2012 Fang et al.
8,141,665 B2 3/2012 Ganz
8,221,517 B2 7/2012 Mirchandani et al.
8,225,886 B2 7/2012 Mirchandani et al.
2002/0004105 A1 1/2002 Kunze et al.
2003/0010409 A1 1/2003 Kunze et al.
2003/0041922 A1 3/2003 Hirose et al.
2003/0219605 A1 11/2003 Molian et al.
2004/0013558 A1 1/2004 Kondoh et al.
2004/0105730 A1 6/2004 Nakajima
2004/0228695 A1 11/2004 Clauson
2004/0234820 A1 11/2004 Majagi
2004/0244540 A1 12/2004 Oldham et al.
2004/0245022 A1 12/2004 Izaguirre et al.
2004/0245024 A1 12/2004 Kembaiyan
2005/0008524 A1 1/2005 Testani
2005/0084407 A1 4/2005 Myrick
2005/0103404 A1 5/2005 Hsieh et al.
2005/0117984 A1 6/2005 Eason et al.
2005/0126334 A1* 6/2005 Mirchandani ..... 75/240
2005/0194073 A1 9/2005 Hamano et al.
2005/0211475 A1 9/2005 Mirchandani et al.
2005/0247491 A1* 11/2005 Mirchandani et al. ..... 175/374
2005/0268746 A1 12/2005 Abkowitz et al.
2006/0016521 A1 1/2006 Hanusiak et al.
2006/0032677 A1 2/2006 Azar et al.
2006/0043648 A1 3/2006 Takeuchi et al.
2006/0060392 A1 3/2006 Eyre
2006/0185773 A1 8/2006 Chiovelli
2006/0286410 A1 12/2006 Ahlgren et al.
2006/0288820 A1 12/2006 Mirchandani et al.
2007/0082229 A1 4/2007 Mirchandani et al.
2007/0102198 A1 5/2007 Oxford et al.
2007/0102199 A1 5/2007 Smith et al.
2007/0102200 A1 5/2007 Choe et al.
2007/0102202 A1 5/2007 Choe et al.
2007/0108650 A1 5/2007 Mirchandani et al.
2007/0126334 A1 6/2007 Nakamura et al.
2007/0163679 A1 7/2007 Fujisawa et al.
2007/0193782 A1 8/2007 Fang et al.
2007/0251732 A1 11/2007 Mirchandani et al.
2008/0011519 A1 1/2008 Smith et al.

| | | | |
|---|---|---|---|
| 2008/0101977 | A1 | 5/2008 | Eason et al. |
| 2008/0196318 | A1 | 8/2008 | Bost et al. |
| 2008/0302576 | A1 | 12/2008 | Mirchandani et al. |
| 2009/0032501 | A1 | 2/2009 | Swingley et al. |
| 2009/0041612 | A1 | 2/2009 | Fang et al. |
| 2009/0136308 | A1 | 5/2009 | Newitt |
| 2009/0180915 | A1 | 7/2009 | Mirchandani et al. |
| 2009/0301788 | A1 | 12/2009 | Stevens et al. |
| 2010/0044114 | A1 | 2/2010 | Mirchandani et al. |
| 2010/0044115 | A1 | 2/2010 | Mirchandani et al. |
| 2010/0278603 | A1 | 11/2010 | Fang et al. |
| 2010/0290849 | A1 | 11/2010 | Mirchandani et al. |
| 2010/0323213 | A1 | 12/2010 | Aitchison et al. |
| 2011/0011965 | A1 | 1/2011 | Mirchandani et al. |
| 2011/0107811 | A1 | 5/2011 | Mirchandani et al. |
| 2011/0265623 | A1 | 11/2011 | Mirchandani et al. |
| 2011/0284179 | A1 | 11/2011 | Stevens et al. |
| 2011/0287238 | A1 | 11/2011 | Stevens et al. |
| 2011/0287924 | A1 | 11/2011 | Stevens |
| 2012/0282051 | A1 | 11/2012 | Mirchandani |
| 2013/0025127 | A1 | 1/2013 | Mirchandani et al. |
| 2013/0025813 | A1 | 1/2013 | Mirchandani et al. |
| 2013/0026274 | A1 | 1/2013 | Mirchandani et al. |

FOREIGN PATENT DOCUMENTS

| | | | |
|---|---|---|---|
| CA | 1158073 | A | 12/1983 |
| CA | 1250156 | A | 2/1989 |
| CA | 2022065 | A1 | 2/1991 |
| CA | 2120332 | | 6/1993 |
| CA | 2107004 | C | 5/1996 |
| CA | 2228398 | A1 | 2/1997 |
| CA | 2198985 | A1 | 9/1998 |
| CA | 2108274 | C | 7/2000 |
| CA | 2212197 | C | 10/2000 |
| CA | 2201969 | C | 2/2003 |
| CA | 2213169 | C | 3/2005 |
| CA | 2498073 | A1 | 8/2006 |
| CA | 2556132 | A1 | 2/2007 |
| CA | 2570937 | A1 | 6/2007 |
| CA | 2357407 | C | 1/2008 |
| DE | 19634314 | A1 | 1/1998 |
| DE | 102006030661 | A1 | 1/2008 |
| EP | 0157625 | A2 | 10/1985 |
| EP | 0264674 | A2 | 4/1988 |
| EP | 0453428 | A1 | 10/1991 |
| EP | 0641620 | B1 | 2/1998 |
| EP | 0995876 | A2 | 4/2000 |
| EP | 1066901 | A2 | 1/2001 |
| EP | 1106706 | A1 | 6/2001 |
| EP | 0759480 | B1 | 1/2002 |
| EP | 1065021 | A1 | 1/2002 |
| EP | 1244531 | B1 | 10/2004 |
| EP | 1686193 | A2 | 8/2006 |
| FR | 2627541 | A2 | 8/1989 |
| GB | 622041 | | 4/1949 |
| GB | 945227 | | 12/1963 |
| GB | 1082568 | | 9/1967 |
| GB | 1309634 | | 3/1973 |
| GB | 1420906 | | 1/1976 |
| GB | 1491044 | | 11/1977 |
| GB | 2158744 | A | 11/1985 |
| GB | 2218931 | A | 11/1989 |
| GB | 2315452 | A | 2/1998 |
| GB | 2324752 | A | 11/1998 |
| GB | 2352727 | A | 2/2001 |
| GB | 2384745 | A | 8/2003 |
| GB | 2385350 | A | 8/2003 |
| GB | 2393449 | A | 3/2004 |
| GB | 2397832 | A | 8/2004 |
| GB | 2435476 | A | 8/2007 |
| JP | 51-124876 | A | 10/1976 |
| JP | 56-52604 | U | 5/1981 |
| JP | 59-54510 | A | 3/1984 |
| JP | 59-56501 | A | 4/1984 |
| JP | 59-67333 | A | 4/1984 |
| JP | 59-169707 | A | 9/1984 |
| JP | 59-175912 | A | 10/1984 |
| JP | 60-48207 | A | 3/1985 |
| JP | 60-172403 | A | 9/1985 |
| JP | 61-226231 | A | 10/1986 |
| JP | 61-243103 | A | 10/1986 |
| JP | 61057123 | B | 12/1986 |
| JP | 62-34710 | A | 2/1987 |
| JP | 62-063005 | A | 3/1987 |
| JP | 62-218010 | A | 9/1987 |
| JP | 62-278250 | A | 12/1987 |
| JP | 1-171725 | A | 7/1989 |
| JP | 2-95506 | A | 4/1990 |
| JP | 2-269515 | A | 11/1990 |
| JP | 3-43112 | A | 2/1991 |
| JP | 3-73210 | A | 3/1991 |
| JP | 5-50314 | A | 3/1993 |
| JP | 5-92329 | A | 4/1993 |
| JP | H05-64288 | | 8/1993 |
| JP | H03-119090 | U | 6/1995 |
| JP | 7-276105 | A | 10/1995 |
| JP | H07-276105 | A | 10/1995 |
| JP | 8-120308 | A | 5/1996 |
| JP | H8-209284 | | 8/1996 |
| JP | 8-294805 | A | 11/1996 |
| JP | 9-11005 | A | 1/1997 |
| JP | H09-011005 | A | 1/1997 |
| JP | 9-192930 | A | 7/1997 |
| JP | 9-253779 | A | 9/1997 |
| JP | 10-138033 | A | 5/1998 |
| JP | 10219385 | A | 8/1998 |
| JP | H10-511740 | A | 11/1998 |
| JP | 11-10409 | A | 1/1999 |
| JP | H11-010409 | A | 1/1999 |
| JP | 11-300516 | A | 11/1999 |
| JP | 2000-237910 | A | 9/2000 |
| JP | 2000-296403 | A | 10/2000 |
| JP | 2000-355725 | A | 12/2000 |
| JP | 2002-097885 | A | 4/2002 |
| JP | 2002-166326 | A | 6/2002 |
| JP | 2002-317596 | A | 10/2002 |
| JP | 2003-306739 | A | 10/2003 |
| JP | 2004-514065 | A | 5/2004 |
| JP | 2004-160591 | A | 6/2004 |
| JP | 2004-181604 | A | 7/2004 |
| JP | 2004-190034 | A | 7/2004 |
| JP | 2005-111581 | A | 4/2005 |
| KR | 20050055268 | | 6/2005 |
| RU | 2135328 | C1 | 8/1999 |
| RU | 2173241 | C2 | 2/2000 |
| RU | 2167262 | C2 | 5/2001 |
| SU | 967786 | A1 | 10/1982 |
| SU | 975369 | A1 | 11/1982 |
| SU | 990423 | A1 | 1/1983 |
| SU | 1269922 | A | 11/1986 |
| SU | 1292917 | A1 | 2/1987 |
| SU | 1350322 | | 11/1987 |
| UA | 6742 | | 12/1994 |
| UA | 63469 | C2 | 1/2006 |
| UA | 23749 | U | 6/2007 |
| WO | WO 92/05009 | A1 | 4/1992 |
| WO | WO 92/22390 | A1 | 12/1992 |
| WO | WO 98/28455 | A1 | 7/1998 |
| WO | WO 99/13121 | A1 | 3/1999 |
| WO | WO 00/43628 | A2 | 7/2000 |
| WO | WO 00/52217 | A1 | 9/2000 |
| WO | WO 01/43899 | A1 | 6/2001 |
| WO | WO 03/010350 | A1 | 2/2003 |
| WO | WO 03/011508 | A2 | 2/2003 |
| WO | WO 03/049889 | A2 | 6/2003 |
| WO | WO 2004/053197 | A2 | 6/2004 |
| WO | WO 2005/045082 | A1 | 5/2005 |
| WO | WO 2005/054530 | A1 | 6/2005 |
| WO | WO 2005/061746 | A1 | 7/2005 |
| WO | WO 2005/106183 | A1 | 11/2005 |
| WO | WO 2006/071192 | A1 | 7/2006 |
| WO | WO 2006/104004 | A1 | 10/2006 |
| WO | WO 2007001870 | A2 | 1/2007 |
| WO | WO 2007/022336 | A2 | 2/2007 |
| WO | WO 2007/030707 | A1 | 3/2007 |
| WO | WO 2007/044791 | A1 | 4/2007 |
| WO | WO 2007/127680 | A1 | 11/2007 |
| WO | WO 2008/098636 | A1 | 8/2008 |

| | | | |
|---|---|---|---|
| WO | WO 97/34726 | A1 | 9/2008 |
| WO | WO 2008/115703 | A1 | 9/2008 |
| WO | WO 2011/008439 | A2 | 1/2011 |

OTHER PUBLICATIONS

Coyle, T.W. and A. Bahrami. "Structure and Adhesion of Ni and Ni-WC Plasma Spray Coatings," Thermal Spray, Surface Engineering via Applied Research, Proceedings of the 1st International Thermal Spray Conference, May 8-11, 2000, Montreal, Quebec, Canada, 2000, pp. 251-254.
Deng, X. et al., "Mechanical Properties of a Hybrid Cemented Carbide Composite," International Journal of Refractory Metals and Hard Materials, Elsevier Science Ltd., vol. 19, 2001, pp. 547.552.
Gurland. Joseph, "Application of Quantitative Microscopy to Cemented Carbides," Practical Applications of Quantitative Matellography, ASTM Special Technical Publication839, ASTM 1984, pp. 65-84.
Hayden, Matthew and Lyndon Scott Stephens, "Experimental Results for a Heat-Sink Mechanical Seal," Tribology Transactions, 48, 2005, pp. 352-361.
Metals Handbook vol. 16 Machining, "Cemented Carbides" (ASM International 1989), pp. 71-89.
Metals Handbook, vol. 16 Machining, "Tapping" (ASM International 1989), pp. 255-267.
Peterman, Walter, "Heat-Sink Compound Protects the Unprotected," Welding Design and Fabrication, Sep. 2003, pp. 20-22.
Shi et al., "Composite Ductility—The Role of Reinforcement and Matrix", TMS Meeting, Las Vegas, NV, Feb. 12-16, 1995, 10 pages.
Sriram, et al., "Effect of Cerium Addition on Microstructures of Carbon-Alloyed Iron Aluminides," Bull. Mater. Sci. vol. 26 No. 6, Oct. 2005, pp. 547-554.
Tracey et al., "Development of Tungsten Carbide-Cobatt-Ruthenium Cutting Tools for Machining Steels" Proceedings Annual Microprogramming Workshop. vol. 14, 1981 pp. 281-292.
Underwood. *Quantitative Stereology*, pp. 23-108(1970).
Vander Vort, "Introduction to Quantitative Metallography", Tech Notes, vol. 1, Issue 5, published by Buehler, Ltd. 1997, 6 pages.
J. Guriand, *Quantitative Microscopy*, R. T. DeHoff and F.N. Rhines, eds., McGraw-Hill Book Company, New York 1968, pp. 279-290.
You Tube, "The Story Behind Kennametal's Beyond Blast", dated Sep. 14, 2010, http://www.youtube.com/watch?v=_A-bYVwmU8 (3 pages) accessed on Oct. 14, 2010.
Kennametal press release on Jun. 10, 2010, http://news.thomasnet.com/companystory/Kennametal-Launches-Beyond-BLAST-TM-at-IMTS-2010-Booth-W-1522-833445 (2 pages) accessed on Oct. 14, 2010.
Pages from Kennametal site, https://www.kennametal.com/en-US/promotions/Beyond_Blast.jhtml (7 pages) accessed on Oct. 14, 2010.
ASM Materials Engineering Dictionary. J.R. Davis. Ed., ASM International Fifth printing, Jan. 2006, p. 98.
Childs et al. "Metal Machining", 2000, Elsevier, p. 111.
Brookes, Kenneth J. A., "World Directory and Handbook of Hardmetals and Hard Materials", International Carbide Data U.K. 1996, Sixth Edition, p. 42.
Firth Sterling grade chart, Allegheny Technologies, attached to Declaration of Prakash Mirchanclani, Ph. D. as flied in U.S. Appl. No. 11/737,993 on Sep. 9, 2000.
Metals Handbook Desk Edition, definition of 'wear', 2nd Ed., J.R. Davis, Editor, ASM International 1998, p. 62.
McGrew-Hill Dictionary of Scientific and Technical Terms, 5th Edition, Sybil P. Parker, Editor in Chief. 1994, pp. 799, 800, 1933, and 2047.
ProKon Version 8.6 The Calculation Companion, Properties for W, Ti, Mo, Co, Ni and FE, Copyright 1997-1998.
TIBTECH Innovations; "Properties table of stainless steel, metals and other conductive materials", printed from http://www.tibtech.com/conductivity.php on Aug. 19. 2011, 1 page.
"Material: Tungsten Carbide (WC), bulk", MEMSnet, printed from http://www.memsnet.org/material/tungstencarbidewcbulk/ on Aug. 19, 2001, 1 page.
Williams; Wendell S., "The Thermal Conductivity of Metallic Ceramics", JOM, Jun. 1998, pp. 62-66.
Brookes, Kenneth J. A., "World Directory and Handbook of Hardmetais and Hard Materials", International Carbide Data U.K. 1996, Sixth Edition, pp. D182-D184.
Thermal Conductivity of Metals, The Engineering ToolBox, printed from http://www.engineeringtoolbox.com/thermal-conductivity-metals-d_858.html on Oct. 27 2011 3 pages.
The Thermal Conductivity of Some Common Materials and Gases, The Engineering ToolBox, printed from http://www.engineeringtoolbox.com/thermal-conductivity-d_429.html on Dec. 15, 2011, 4 pages.
ASTM G65-04, Standard lest Method for Measuring Abrasion Using the Dry Sand, Nov. 1, 2004, printed from http://infostore.saiglobal.com.
Tool and Manufacturing Engineers Handbook, Fourth Edition, vol. 1, Machining, Society of Manufacturing Engineers, Chapter 12, vol. 1, 1983, pp. 12-110-12-114.
Beard, T. "The INS and OUTS of Thread Milling; Emphasis: Hole Making, Interview", Modern Machine Shop, Gardner Publications Inc. 1991, vol. 64, No. 1, 5 pages.
Koelsch, J., "Thread Milling Takes on Tapping", Manufacturing Engineering, 1995, vol. 115, No, 4, 6 pages.
Johnson M. "Tapping", Traditional Machining Processes, 1997, p. 255-265.
"Thread Milling" Traditional Machining Processes, 1997, pp. 268-269.
Scientific Cutting Tools "The Cutting Edge", 1998, printed on Feb. 1, 2000, 15 pages.
Helical Carbide Thread Mills, Schinarje Tool Company, 1998, 2 pages.
Pyrotek, Zyp Zircwash, www.pyrotek.info, Feb. 2003. 1 page.
Sims et al , "Casting Engineering", Superalloys II, Aug. 1987, pp. 420-426.
Sikkenga, "Cobalt and Cobolt Alloy Castings", Casting, vol. 15, ASM Handbook, ASM International, 2008, pp. 1114-1118.
Starck, H.C., Surface Technology, Powders for PTA-Welding, Lasercladding and other Wear Protective Welding Applications; Jan. 2011, 4 pages.
U.S. Appl. No. 13/487,323, filed Jun. 4, 2012, (32 pages).
U.S. Appl. No. 13/491,649, filed Jun. 8, 2012, (55 pages).
U.S. Appl No. 13/558,769, filed Jul. 26 2012, 2012, (62 pages).
U.S. App. No. 13/591,282, filed Aug. 22, 2012, 2012, (54 pages).
Office Action mailed Mar. 12, 2009 in U.S. Appl. No. 11/585,408.
Office Action mailed Sep. 22, 2009 in U.S. Appl. No. 11/585,408.
Office Action mailed Sep. 7 2010 in U.S. Appl. No. 11/585,408.
Office Action mailed Feb. 16, 2011 in U.S. Appl. No. 11/585,408.
Advisory Action mailed May 3, 2011 in U.S. Appl. No. 11/585,408.
Office Action mailed Aug. 17, 2011 in U.S. Appl. No. 11/585,408.
Notice of Allowance mailed May 9, 2012 in U.S. Appl. No. 11/585,406.
Notice of Allowance mailed Jul. 20, 2012 in U.S. Appl. No. 11/585,408.
Restriction Requirement mailed Jul. 24, 2008 in U.S. Appl. No. 11/157,811.
Office Action mailed Oct. 21, 2008 in U.S. Appl. No. 11/157,811.
Final Office Action mailed Jun. 12, 2009 in U.S. Appl. No. 11/167,811.
Office Action mailed Aug. 28, 2009 in U.S. Appl. No. 11/167,811.
Office Action mailed Mar. 2, 2010 in U.S. Appl. No. 11/167,811.
Office Action mailed Aug. 19, 2010 in U.S. Appl. No. 11/167,811.
Advisory Action Before the Filing of an Appeal Brief mailed May 12, 2010 in U.S. Appl. No. 11/167,811.
Office Action mailed Feb. 3, 2011 in U.S. Appl. No. 11/167,611.
Advisory Action mailed May 11, 2011 in U.S. Appl. No. 11/167,811.
Office Action mailed Jul. 22, 2011 in U.S. Appl. No. 11/167,811.
Office Action mailed Mar. 28, 2012 in U.S. Appl. No. 11/167,811.
Office Action mailed Mar. 19, 2009 in U.S. Appl. No. 11/737,993.
Office Action mailed Jun. 3, 2009 in U.S. Appl. No. 11,737,993.
Office Action mailed Dec. 9, 2009 in U.S. Appl. No. 11/737,993.
Office Action mailed Feb. 24, 2010 in U.S. Appl. No. 11/737,993.
Office Action mailed Jun. 29, 2010 in U.S. Appl. N., 11/737,993.

Advisory Action Before the Filing of an Appeal Brief mailed Sep. 9, 20110 in U.S. Appl. No. 11/737,993.
Pre-Brief Appeal Conference Decision mailed Nov. 22, 2010 in U.S. Appl. No. 11/737,993.
Office Action mailed Apr. 20, 2011 in U.S. Appl. No. 11/737,993.
Office Action mailed Aug. 3, 2011 in U.S. Appl. No. 11/737,993.
Office Action mailed Oct. 11, 2011 in U.S. Appl. No. 11/737,993.
Office Action mailed Jan. 6, 2012 in U.S. Appl. No. 11/737,993.
Advisory Action Before the Filing of an Appeal Brief mailed Mar. 22, 2012 in U.S. Appl. No. 11/737,993.
Notice of Allowance mailed Jul. 25, 2012 in U.S. Appl. No. 11/737,993.
Restriction requirement mailed Sep. 17, 2010 in Appl. No. 12,397,597.
Office Action mailed Nov. 15, 2010 in U.S. Appl. No. 12/397,597.
Office Action mailed Jun. 7, 2011 in U.S. Appl. No. 12/397,597.
Advisory Action Before the Filing of an Appeal Brief mailed Aug. 31, 2011 in U.S. Appl. No. 12/397,597.
Office Action mailed Nov. 17, 2011 in U.S. Appl. No. 12,397,597.
Advisory Acton mailed Jan. 26, 2012 in U.S. Appl. No. 12/397,597.
Office Action mailed Apr. 13, 2012 in U.S. Appl. No. 12/397,597.
Office Action mailed Dec. 29, 2005 in U.S. Appl. No. 10/903,198.
Office Action mailed Sep. 29, 2006 in U.S. Appl. No. 10/903,198.
Office Action mailed Mar. 27, 20137 in U.S. Appl. No. 10/903 198.
Office Action mailed Sep. 26, 2007 in U.S. Appl. No. 10/903,198.
Office Action mailed Jan. 16, 2008 is U.S. Appl. No. 10/903,198.
Office Action mailed Oct. 31, 2008 in U.S. Appl. No. 10/903,198.
Office Action mailed Apr. 17, 2009 in U.S. Appl. No. 10/903,198.
Advisory Action before mailing of Appeal Brief mailed Jun. 29, 2009 in U.S. Appl. No. 10/903,198.
Examiner's Answer mailed Aug. 17, 2010 in U.S. Appl. No. 10/903,198.
Office Action mailed Apr. 22, 2010 in U.S. Appl. No. 12/196,951.
Office Action mailed Oct. 29, 2010 in U.S. Appl. No. 12/196,951.
Office Action mailed Apr. 12, 2011 in U.S. Appl. No. 12/196,951.
Office Action mailed Oct. 19, 2011 in U.S. Appl. No. 12/196,951.
Office Action mailed Mar. 19, 2012 in U.S. Appl. No. 12/196,951.
Notice of Allowance Jul. 31, 2012 in U.S. Appl. No. 12/196,951.
Office Action mailed Oct. 13, 2011 in U.S. Appl. No. 12/179,999.
Notice of Allowance maiied Apr. 30, 2012 in U.S. Appl. No. 12/179,999.
Office Action mailed Aug. 29, 2011 in U.S. Appl. No. 12/476,738.
Office Action mailed Dec. 21, 2011 in U.S. Appl. No. 12/476,738.
Notice of Allowance mailed Apr. 17, 2012 in U.S. Appl. No. 12/476,738.
Corrected Notice of Allowability mailed Jun. 21, 2012 in U.S. Appl. No. 12/476,738.
Office Action mailed Nov. 14, 2011 in U.S. Appl. No. 12/502,277.
Office Action mailed Jan. 20, 2012 in U.S. Appl. No. 12/502,277.
Notice of Allowance mailed Jul. 10, 2012 in U.S. Appl. No. 12/502,277.
Supplemental Notice Allowability mailed Jul. 20, 2012 in U.S. Appl. No. 12/502,277.
Office Action mailed Mar. 15, 2012 in U.S. Appl. No. 12/464,607.
Notice of Allowance mailed Apr. 9, 2012 in U.S. Appl. No. 12/464,607.
Notice of Allowance mailed Jul. 16, 2012 in U.S. Appl. No. 12/464,607.
Office Action mailed Oct. 31 in U.S. Appl. No. 13/207,478.
Office Action mailed Mar. 2, 2012 in U.S. Appl. No. 13/207,478.
Notice of Allowance mailed Apr. 13, 2012 in U.S. Appl. No. 13/207,478.
Supplemental Notice of Allowability mailed Jun. 29, 2012 in U.S. Appl. No. 13/207,478.
Office Action mailed Dec. 5, 2011 in U.S. Appl. No. 13/162,474.
Office Action mailed Apr. 27, 2012 in U.S. Appl. No. 13/182,474.
Notice of Allowance mailed Jul. 18, 2012 in U.S. Appl. No. 13/182,474.
Office Action mailed Jun. 1. 2001 in U.S. Appl. No. 09/460,540.
Office Action mailed Dec. 1, 2001 in U.S. Appl. No. 09/460,540.
Office Action mailed Mar. 15, 2002 in U.S. Appl. No. 09/460,540.
Office Action mailed Jun. 18, 2002 in U.S. Appl. No. 09/460,540.
Notice of Allowance mailed Oct. 21, 2002 in U.S. Appl. No. 09/460,540.
Office Action mailed Jan. 16, 2007 in U.S. Appl. No. 11/013,842.
Office Action mailed Jul. 16, 2008 in U.S. Appl. No. 11/013,842.
Office Action mailed Jul. 30, 2007 in U.S. Appl. No. 11/013,842.
Notice of Allowance mailed Nov. 26, 2008 in U.S. Appl. No. 11/013,842.
Office Action mailed Oct. 13, 2006 in U.S. Appl. No. 10/922,750.
Notice of Allowance mailed May 21, 2007 for U.S. Appl. No. 10/922,750.
Supplemental Notice of Allowability mailed Jul. 3. 2007 for U.S. Appl. No. 10/922,750.
Office Action mailed May 14, 2009 in U.S. Appl. No. 11/667,343.
Office Action mailed Jan. 21, 2010 in U.S. Appl. No. 11/687,343.
Notice of Allowance mailed May 18, 2010 in U.S. Appl. No. 11/687,343.
Restriction Requirement mailed Aug. 4, 2010 in U.S. Appl. No. 12/196,815.
Office Action mailed Oct. 27, 2010 in U.S. Appl. No. 12/196,815.
Office Action mailed Nov. 17, 2010 in U.S. Appl. No. 12/196,815.
Notice of Allowance mailed Jan. 27, 2011 in U.S. Appl. No. 12/196,815.
Notice of Allowance mailed May 16 2011 in U.S. Appl. No. 12/196,815.
Office Action mailed Aug. 31, 2007 in U.S. Appl. No. 11/206,368.
Office Action mailed Feb. 28, 2008 in U.S. Appl. No. 11/206,368.
PreAppeal Conference Decision mailed Jun. 19, 2008 in U.S. Appl. No. 11/206,368.
Notice of Allowance mailed Nov. 13, 2008 in U.S. Appl. No. 11/206,368.
Office Action mailed Apr. 30, 2009 in U.S. Appl. No. 11/206,368.
Notice of Allowance mailed Nov. 30. 2009 in U.S. Appl. No. 11/206,368.
Office Action mailed Sep. 2. 2011 in Appl. No. 12/850,003.
Notice of Allowance mailed Nov. 15, 2011 in U.S. Appl. No. 12/850,003
Office Action mailed May 3, 2010 in U.S. Appl. No. 11/924,273.
Office Action mailed Oct. 14, 2010 in U.S. Appl. No. 11/924,273,
Office Action mailed Feb. 2, 2011 in U.S. Appl. No. 11/924,273.
Interview Summary mailed Feb. 16, 2011 in U.S. Appl. No. 11/924,273.
Interview Summary mailed May 9, 2011 in U.S. Appl. No. 11/924,273.
Notice of Allowance mailed Jun. 24, 2011 in U.S. Appl. No. 11/924,273.
Ancormet® 101, Data Sheet, 0001-AM101-D-1, Hoeganaes www.hoeganaes.com, 7 pages. (date unavailable).
Nassau, K. Ph.D. and Julia Nassau, "The History and Present Status of Synthetic Diamond, Part I and II", reprinted from The Lapidary Journal, Inc., vol. 32, No. 1, Apr. 1978; vol. 32, No. 2, May 1978, 15 pages.
Specialty Metals, "Tungchip Dispenser, An improved feeder design, to allow for accurate delivery of Tungsten Carbide granules into the molten weld pool, generated by a MIG (GMAW) welding system", (undated) 2 pages.
Dynalloy Industries, G.M.A.C.E, 2003, printed Jul. 8, 2009, 1 page.
Alloys International (Australasia) Pty. Ltd., "The Tungsten Carbide Vibratory Feeder System", (undated) 6 pages.
Dynalloy Industries, Hardhead Technology, Tungsten Carbide Pellets, 2003, printed Jul. 8, 2009, 1 page.
Lincoln Electric, MIG Carbide Vibratory Feeder Assembly, (undated) 1 page.
Wearshield Hardfacing Electrodes, Tungsten Carbide Products, (undated) 1 page.
Postalloy, The best in hardfacing, Postle Industries, Inc., (undated) 13 pages.
Postalloy, Postle Industries, Inc., Postalloy PS-98, Tungsten Matrix Alloy, (undated) 1 page.
Postalloy, Data Sheet, Postle Industries, Inc., Postalloy 299-SPL, (undated) 1 page.
Postalloy, Data Sheet, Postle Industries, Inc., Postalloy CP 63070, (undated) 1 page.

Postalloy, Data Sheet, Postle Industries, Inc., Postalloy 14 TC, (undated) 1 page.
Postalloy, Data Sheet, Postle Industries, Inc., Postalloy PS-98, A Tungsten Carbide Matrix Wire for Carbide Embedding, (undated) 1 page.
Industrial Renewal Services, Steel BOC (Basic Oxygen Furnace) & BOP (Basic Oxygen Process) Hoods, printed Nov. 8, 2007, 2 pages.
UWO Products, printed Nov. 8, 2007 from http://www.universalweld.com/products.htm, 2 pages.
U.S. Appl. No. 13/652,508, filed Oct. 16, 2012 (46 pages).
Office Action mailed Jan. 23, 2013 in U.S. Appl. No. 13/652,508.
U.S. Appl. No. 13/652,503, filed Oct. 16, 2012 (26 pages).
U.S. Appl. No. 13/632,177, filed Oct. 1, 2012 (40 pages).
U.S. Appl. No. 13/632,178, filed Oct. 1, 2012 (51 pages).
Restriction Requirement mailed Jan. 3, 2013 in U.S. Appl. No. 13/632,178.
U.S. Appl. No. 13/222,324, filed Aug. 31, 2011, (36 pages).
Office Action mailed Jun. 28, 2012 in U.S. Appl. No. 13/222,324.
Office Action mailed Jul. 11, 2012 in U.S. Appl. No. 13/222,324.
Office Action mailed Nov. 6, 2012 in U.S. Appl. No. 13/222,324.
Notification of Reopening of Prosecution Due to Consideration of an Information Disclosure Statement filed After Mailing of a Notice of Allowance mailed Oct. 10, 2012 in U.S. Appl. No. 13/182,474.
Corrected Notice of Allowability mailed Oct. 18, 2012 in U.S. Appl. No. 11/585,408.

* cited by examiner

EARTH-BORING BITS AND OTHER PARTS INCLUDING CEMENTED CARBIDE

CROSS-REFERENCE TO RELATED APPLICATIONS

This application claims priority under 35 U.S.C. §120 as a continuation of co-pending U.S. patent application Ser. No. 13/207,478, filed Aug. 11, 2011, which claims priority under 35 U.S.C. §120 as a continuation of U.S. patent application Ser. No. 12/196,815, filed Aug. 22, 2008, now U.S. Pat. No. 8,025,112.

BACKGROUND OF THE TECHNOLOGY

1. Field of the Technology

The present disclosure relates to earth-boring articles and other articles of manufacture comprising sintered cemented carbide and to their methods of manufacture. Examples of earth-boring articles encompassed by the present disclosure include, for example, earth-boring bits and earth-boring bit parts such as, for example, fixed-cutter earth-boring bit bodies and roller cones for rotary cone earth-boring bits. The present disclosure further relates to earth-boring bit bodies, roller cones, and other articles of manufacture made using the methods disclosed herein.

2. Description of the Background of the Technology

Cemented carbides are composites of a discontinuous hard metal carbide phase dispersed in a continuous relatively soft binder phase. The dispersed phase, typically, comprises grains of a carbide comprising one or more of the transition metals selected from, for example, titanium, vanadium, chromium, zirconium, hafnium, molybdenum, niobium, tantalum, and tungsten. The binder phase typically comprises at least one of cobalt, a cobalt alloy, nickel, a nickel alloy, iron, and an iron alloy. Alloying elements such as, for example, chromium, molybdenum, ruthenium, boron, tungsten, tantalum, titanium, and niobium may be added to the binder to enhance certain properties of the composite. The binder phase binds or "cements" the metal carbide regions together, and the composite exhibits an advantageous combination of the physical properties of the discontinuous and continuous phases.

Numerous cemented carbide types or "grades" are produced by varying parameters that may include the composition of the materials in the dispersed and/or continuous phases, the grain size of the dispersed phase, and the volume fractions of the phases. Cemented carbides including a dispersed tungsten carbide phase and a cobalt binder phase are the most commercially important of the commonly available cemented carbide grades. The various grades are available as powder blends (referred to herein as a "cemented carbide powder") which may be processed using conventional press-and-sinter techniques to form the cemented carbide composites.

Cemented carbide grades including a discontinuous tungsten carbide phase and a continuous cobalt binder phase exhibit advantageous combinations of strength, fracture toughness, and wear resistance. As is known in the art, "strength" is the stress at which a material ruptures or fails. "Fracture toughness" refers to the ability of a material to absorb energy and deform plastically before fracturing. "Toughness" is proportional to the area under the stress-strain curve from the origin to the breaking point. See McGraw-Hill Dictionary of Scientific and Technical Terms ($5^{th}$ ed. 1994). "Wear resistance" refers to the ability of a material to withstand damage to its surface. Wear generally involves progressive loss of material, due to a relative motion between a material and a contacting surface or substance. See Metals Handbook Desk Edition (2d ed. 1998). Cemented carbides find extensive use in applications requiring substantial strength, toughness, and high wear resistance, such as, for example, in metal cutting and metal forming applications, in earth-boring and rock cutting applications, and as wear parts in machinery.

The strength, toughness, and wear resistance of a cemented carbide are related to the average grain size of the dispersed hard phase and the volume (or weight) fraction of the binder phase present in the composite. Generally, an increase in the average grain size of the carbide particles and/or an increase in the volume fraction of the binder in a conventional cemented carbide powder grade increases the fracture toughness of the formed composite. However, this increase in toughness is generally accompanied by decreased wear resistance. Metallurgists formulating cemented carbides, therefore, are continually challenged to develop grades exhibiting both high wear resistance and high fracture toughness and which are suitable for use in demanding applications.

In general, cemented carbide parts are produced as individual parts using conventional powder metallurgy press-and-sinter techniques. The manufacturing process typically involves consolidating or pressing a portion of a cemented carbide powder in a mold to provide an unsintered, or "green", compact of defined shape and size. If additional shape features are required in the cemented carbide part that cannot be readily achieved by pressing or otherwise consolidating the powder, the consolidation or pressing operation is followed by machining the green compact, which is also referred to as "green shaping". If additional compact strength is needed for the green shaping process, the green compact can be presintered before green shaping. Presintering occurs at a temperature lower than the final sintering temperature and provides a "brown" compact. The green shaping operation is followed by a high temperature treatment, commonly referred to as "sintering". Sintering densifies the material to near theoretical full density to produce a cemented carbide composite and optimize the strength and hardness of the material.

A significant limitation of press-and-sinter fabrication techniques is that the range of compact shapes that can be formed is rather limited, and the techniques cannot effectively be used to produce complex part shapes. Pressing or consolidation of powders is usually accomplished using mechanical or hydraulic presses and rigid tooling or, alternatively, isostatic pressing. In the isostatic pressing technique shaping forces may be applied from different directions to a flexible mold. A "wet bag" isostatic pressing technique utilizes a portable mold disposed in a pressure medium. A "dry bag" isostatic pressing technique involves a mold having symmetry in the radial direction. Whether rigid tooling or flexible tooling is used, however, the consolidated compact must be extracted from the tool, and this limitation limits the compact shapes that can formed. In addition, compacts larger than about 4 to 6 inches in diameter and about 4 to 6 inches in length must be consolidated in isostatic presses. Since isostatic presses use flexible tooling, however, pressed compacts with precise shapes cannot be formed.

As indicated above, additional shape features can be incorporated into a compact for a cemented carbide part by green shaping a brown compact after presintering. However, the range of shapes that are possible from green shaping is limited. The possible shapes are limited by the availability and capabilities of the machine tools. Machine tools that may be used in green machining must be highly wear resistant and are generally expensive. Also, green machining of compacts used to form cemented carbide parts produces highly abrasive dust. In addition, consideration must be given to the design of the component in that the shape features to be formed on the compacts cannot intersect the path of the cutting tool.

Cemented carbide parts having complex shapes may be fabricated by attaching together two or more cemented carbide pieces using conventional metallurgical joining techniques such as, for example, brazing, welding, and diffusion bonding, or using mechanical attachment techniques such as, for example, shrink fitting, press fitting, or the use of mechanical fasteners. However, both metallurgical and mechanical joining techniques are deficient because of the inherent properties of cemented carbide and/or the mechanical properties of the joint. Because typical brazing or welding alloys have strength levels much lower than cemented carbides, brazed and welded joints are likely to be much weaker than the attached cemented carbide pieces. Also, since the brazing and welding deposits do not include carbides, nitrides, silicides, oxides, borides, or other hard phases, the braze or weld joint also is much less wear resistant than the cemented carbide materials. Mechanical attachment techniques generally require the presence of features such as keyways, slots, holes, or threads on the components being joined together. Providing such features on cemented carbide parts results in regions at which stress concentrates. Because cemented carbides are relatively brittle materials, they are extremely notch-sensitive, and the stress concentrations associated with mechanical joining features may readily result in premature fracture of the cemented carbide.

A method of making cemented carbide parts having complex shapes, for example, earth-boring bits and bit bodies, exhibiting suitable strength, wear resistance, and fracture toughness for demanding applications and which lack the drawbacks of parts made by the conventional methods discussed above would be highly desirable.

In addition, a method of making cemented carbide parts including regions of non-cemented carbide material, such as a readily machinable metal or metallic (i.e., metal-containing) alloy, without significantly compromising the strength, wear resistance, or fracture toughness of the bonding region or the part overall likewise would be highly desirable. A particular example of a part that would benefit from manufacture by such a method is a cemented carbide-based fixed-cutter earth-boring bit. Fixed-cutter earth-boring bits basically include several inserts secured to a bit body in predetermined positions to optimize cutting. The cutting inserts typically include a layer of synthetic diamond sintered on a cemented carbide substrate. Such inserts are often referred to as polycrystalline diamond compacts (PDC).

Conventional bit bodies for fixed-cutter earth-boring bits have been made by machining the complex features of the bits from steel, or by infiltrating a bed of hard carbide particles with a binder alloy, such as, for example a copper-base alloy. Recently, it has been disclosed that fixed-cutter bit bodies may be fabricated from cemented carbides employing standard powder metallurgy practices (powder consolidation, followed by shaping or machining the green or presintered powder compact, and high temperature sintering). Co-pending U.S. patent applications, Ser. Nos. 10/848,437 and 11/116,752, disclose the use of cemented carbide composites in bit bodies for earth-boring bits, and each such application is hereby incorporated herein by reference in its entirety. Cemented carbide-based bit bodies provide substantial advantages over machined steel or infiltrated carbide bit bodies since cemented carbides exhibit particularly advantageous combinations of high strength, toughness, and abrasion and erosion resistance relative to machined steel or infiltrated carbides.

FIG. 1 is a schematic illustration of a fixed-cutter earth-boring bit body on which PDC cutting inserts may be mounted. Referring to FIG. 1, the bit body 20 includes a central portion 22 including holes 24 through which mud is pumped, and arms or "blades" 26 including pockets 28 in which the PDC cutters are attached. The bit body 20 may further include gage pads 29 formed of hard, wear-resistant material. The gage pads 29 and provided to inhibit bit wear that would reduce the effective diameter of the bit to an unacceptable degree. Bit body 20 may consist of cemented carbide formed by powder metallurgy techniques or by infiltrating hard carbide particles with a molten metal or metallic alloy. The powder metallurgy process includes filling a void of a mold with a blend of binder metal and carbide powders, and then compacting the powders to form a green compact. Due to the high strength and hardness of sintered cemented carbides, which makes machining the material difficult, the green compact typically is machined to include the features of the bit body, and then the machined compact is sintered. The infiltration process entails filling a void of a mold with hard particles, such as tungsten carbide particles, and infiltrating the hard particles in the mold with a molten metal or metal alloy, such as a copper alloy. In certain bit bodies manufactured by infiltration, small pieces of sintered cemented carbide are positioned around one or more of the gage pads to further inhibit bit wear, In such cases, the total volume of the sintered cemented carbide pieces is less than 1% of the bit body's total volume.

The overall durability and service life of fixed-cutter earth-boring bits depends not only on the durability of the cutting elements, but also on the durability of the bit bodies. Thus, earth-boring bits including solid cemented carbide bit bodies may exhibit significantly longer service lifetimes than bits including machined steel or infiltrated hard particle bit bodies. However, solid cemented carbide earth-boring bits still suffer from some limitations. For example, it can be difficult to accurately and precisely position the individual PDC cutters on solid cemented carbide bit bodies since the bit bodies experience some size and shape distortion during the high temperature sintering process. If the PDC cutters are not located precisely at predetermined positions on the bit body blades, the earth-boring bit may not perform satisfactorily due to, for example, premature breakage of the cutters and/or the blades, excessive vibration, and/or drilling holes that are not round ("out-of-round holes").

Also, because solid, one-piece, cemented carbide bit bodies have complex shapes (see FIG. 1), the green compacts commonly are machined using sophisticated machine tools, such as five-axis computer controlled milling machines. However, as discussed hereinabove, even the most sophisticated machine tools can provide only a limited range of shapes and designs. For example, the number and shape of cutting blades and the PDC cutters mounting positions that may be machined is limited because shape features cannot interfere with the path of the cutting tool during the machining process.

Thus, there is a need for improved methods of making cemented carbide-based earth-boring bit bodies and other parts and that do not suffer from the limitations of known manufacturing methods, including those discussed above.

SUMMARY

One aspect of the present disclosure is directed to an article of manufacture including at least one cemented carbide piece, wherein the total volume of cemented carbide pieces is at least 5% of a total volume of the article of manufacture, and a joining phase binding the at least one cemented carbide piece into the article of manufacture. The joining phase includes inorganic particles and a matrix material including at least one of a metal and a metallic alloy. The melting temperature of the inorganic particles is higher than a melting temperature of the matrix material.

Another aspect of the present disclosure is directed to an article of manufacture that is an earth-boring article. The earth-boring article includes at least one cemented carbide piece. The cemented carbide piece has a cemented carbide volume that is at least 5% of the total volume of the earth-boring article. A metal matrix composite binds the cemented carbide piece into the earth-boring article. The metal matrix composite comprises hard particles dispersed in a matrix comprising a metal or a metallic alloy.

Yet another aspect of the present disclosure is directed to a method of making an article of manufacture including a cemented carbide region, wherein the method includes positioning at least one cemented carbide piece and, optionally, a non-cemented carbide piece in a void of a mold in predetermined positions to partially fill the void and define an unoccupied space in the void. The volume of the at least one cemented carbide piece is at least 5% of a total volume of the article of manufacture. A plurality of inorganic particles are added to partially fill the unoccupied space. The space between the inorganic particles is a remainder space. The cemented carbide piece, the non-cemented carbide piece if present, and the plurality of hard particles are heated. A molten metal or a molten metal alloy is infiltrated into the remainder space. The melting temperature of the molten metal or the molten metal alloy is less than the melting temperature of the plurality of inorganic particles. The molten metal or the molten metal alloy in the remainder space is cooled, and the solidified molten metal or molten metal alloy binds the cemented carbide piece, the non-cemented carbide piece if present, and the inorganic particles to form the article of manufacture.

An additional aspect according to the present disclosure is directed to a method of making a fixed-cutter earth-boring bit, wherein the method includes positioning at least one sintered cemented carbide piece and, optionally, at least one non-cemented carbide piece in a void of a mold, thereby defining an unoccupied portion of the void. The total volume of the cemented carbide pieces positioned in the void of the mold is at least 5% of the total volume of the fixed-cutter earth-boring bit. Hard particles are disposed in the void to occupy a portion of the unoccupied portion of the void and define an unoccupied remainder portion in the void of the mold. The mold is heated to a casting temperature, and a molten metallic casting material is added to the mold. The melting temperature of the molten metallic casting material is less than the melting temperature of the inorganic particles. The molten metallic casting material infiltrates the remainder portion in the mold. The mold is cooled to solidify the molten metallic casting material and bind the at least one sintered cemented carbide and, if present, the at least one non-cemented carbide piece, and the hard particles into the fixed-cutter earth-boring bit. The cemented carbide piece is positioned within the void to form at least part of a blade region of the fixed-cutter earth-boring bit, and the non-cemented carbide piece, if present, forms at least a part of an attachment region of the fixed-cutter earth-boring bit.

According to one non-limiting aspect of the present disclosure, an article of manufacture disclosure includes at least one cemented carbide piece, and a joining phase binding the at least one cemented carbide piece into the article of manufacture, wherein the joining phase is composed of a eutectic alloy material.

A further non-limiting aspect according to the present disclosure is directed to a method of making an article of manufacture comprising a cemented carbide portion, wherein the method includes placing a sintered cemented carbide piece next to at least one adjacent piece. The sintered cemented carbide piece and the adjacent piece define a filler space. A blended powder composed of a metal alloy eutectic composition is added to the filler space. The cemented carbide piece, the adjacent piece, and the powder are heated to at least a eutectic melting point of the metal alloy eutectic composition. The cemented carbide piece, the adjacent piece, and the metal alloy eutectic composition are cooled, and the solidified metal alloy eutectic material joins the cemented carbide component and the adjacent component.

BRIEF DESCRIPTION OF THE DRAWINGS

The features and advantages of methods and articles of manufacture described herein may be better understood by reference to the accompanying drawings in which.

The reader will appreciate the foregoing details, as well as others, upon considering the following detailed description of certain non-limiting embodiments according to the present disclosure.

DETAILED DESCRIPTION OF CERTAIN NON-LIMITING EMBODIMENTS

In the present description of non-limiting embodiments, other than in the operating examples or where otherwise indicated, all numbers expressing quantities or characteristics are to be understood as being modified in all instances by the term "about". Accordingly, unless indicated to the contrary, any numerical parameters set forth in the following description are approximations that may vary depending on the desired properties one seeks to obtain by the methods and in the articles according to the present disclosure. At the very least, and not as an attempt to limit the application of the doctrine of equivalents to the scope of the claims, each such numerical parameter should at least be construed in light of the number of reported significant digits and by applying ordinary rounding techniques.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

According to an aspect of the present disclosure, an article of manufacture such as, for example, but not limited to, an earth-boring bit body, includes at least one cemented carbide piece and a joining phase that binds the cemented carbide piece into the article. The cemented carbide piece is a sintered material and forms a portion of the final article. The joining phase may include inorganic particles and a continuous metallic matrix including at least one of a metal and a metallic alloy. It is recognized in this disclosure that unless specified otherwise hereinbelow, the terms "cemented carbide", "cemented carbide material", and "cemented carbide composite" refer to a sintered cemented carbide. Also, unless specified otherwise hereinbelow, the term "non-cemented carbide" as used herein refers to a material that either does not include cemented carbide material or, in other embodiments, includes less than 2% by volume cemented carbide material.

Figure 1:
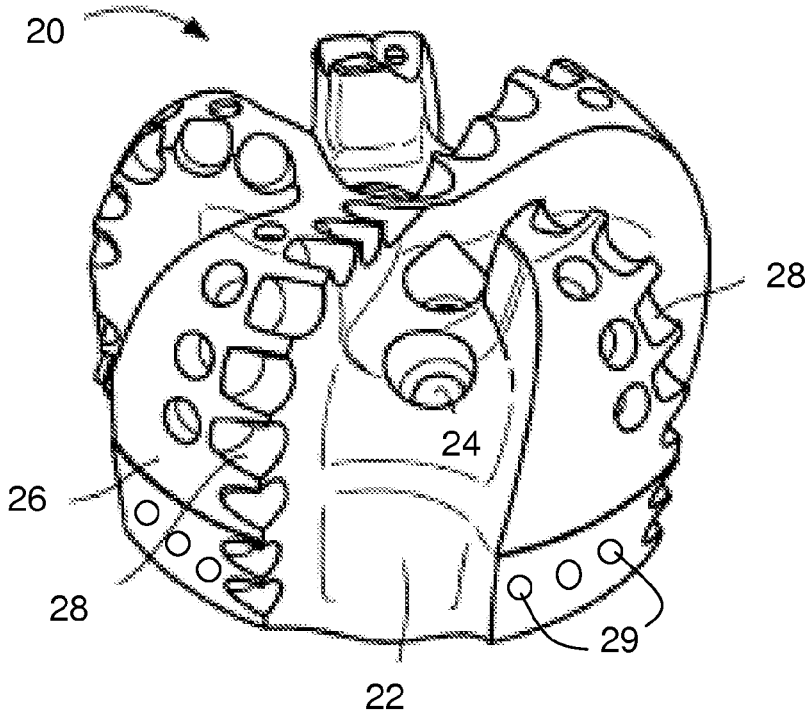
FIG. 1 is a schematic perspective view of a fixed-cutter earth-boring bit body fabricated from either solid cemented carbide or infiltrated hard particles.
Figure 2:
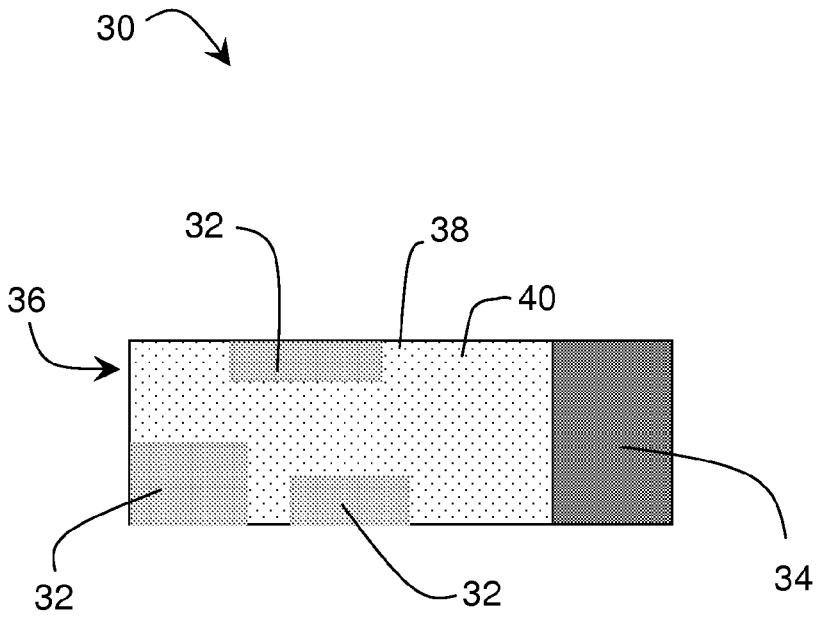
FIG. 2 is a schematic side view of one non-limiting embodiment of an article of manufacture including cemented carbide according to the present disclosure.

FIG. 2 is a schematic side view representation of one non-limiting embodiment of a complex cemented carbide-containing article 30 according to the present disclosure. Article 30 includes three sintered cemented carbide pieces 32 disposed at predetermined positions within the article 30. In certain non-limiting embodiments, the combined volume of one or more sintered cemented carbide pieces in an article according to the present disclosure is at least 5% of the article's total volume, or in other embodiments may be at least 10% of the article's total volume. According to a possible further aspect of the present disclosure, article 30 also includes a non-cemented carbide piece 34 disposed at a predetermined position in the article 30. The cemented carbide pieces 32 and the non-cemented carbide piece 34 are bound into the article 30 by a joining phase 36 that includes a plurality of inorganic particles 38 in a continuous metallic matrix 40 that includes at least one of a metal and a metallic alloy. While FIG. 1 depicts three cemented carbide pieces 32 and a single non-cemented carbide piece 34 bonded into the article 30 by the joining phase 36, any number of cemented carbide pieces and, if present, non-cemented carbide pieces may be included in articles according to the present disclosure. It also will be understood that certain non-limiting articles according to the present disclosure may lack non-cemented carbide pieces.

While not meant to be limiting, in certain embodiments the one or more cemented carbide pieces included in articles according to the present disclosure may be prepared by conventional techniques used to make cemented carbide. One such conventional technique involves pressing precursor powders to form compacts, followed by sintering to densify the compacts and metallurgically bind the powder components together, as generally discussed above. The details of pressing-and-sinter techniques applied to the fabrication of cemented carbides are well known to persons having ordinary skill in the art, and further description of such details need not be provided herein.

In certain non-limiting embodiments of articles including cemented carbide according to the present disclosure, the one or more cemented carbide pieces bonded into the article by the joining phase include a discontinuous, dispersed phase of at least one carbide of a metal selected from Groups IVB, a Group VB, or a Group VIB of the Periodic Table, and a continuous binder phase comprising one or more of cobalt, a cobalt alloy, nickel, a nickel alloy, iron, and an iron alloy. In still other non-limiting embodiments, the binder phase of a cemented carbide piece includes at least one additive selected from chromium, silicon, boron, aluminum, copper, ruthenium, and manganese. In certain non-limiting embodiments, the binder phase of a cemented carbide piece may include up to 20 weight percent of the additive. In other non-limiting embodiments, the binder phase of a cemented carbide piece may include up to 15 weight percent, up to 10 weight percent, or up to 5 weight percent of the additives.

All or some of the cemented carbide pieces in certain non-limiting embodiments of articles according to the present disclosure may have the same composition or are of the same cemented carbide grade. Such grades include, for example, cemented carbide grades including a tungsten carbide discontinuous phase and a cobalt-containing continuous binder phase. The various commercially available powder blends used to produce various cemented carbide grades are well known to those of ordinary skill in the art. The various cemented carbide grades typically differ in one or more of carbide particle composition, carbide particle grain size, binder phase volume fraction, and binder phase composition, and these variations influence the final properties of the composite material. In certain embodiments, the grade of cemented carbide from which two or more of the carbide pieces included in the article varies. The grades of cemented carbide in the cemented carbide pieces included in articles according to the present disclosure may be varied throughout the article to provide desired combinations of properties such as, for example, toughness, hardness, and wear resistance, at different regions of the article. Also, the size and shape of cemented carbide pieces and, if present, non-cemented carbide pieces included in articles of the present disclosure may be varied as desired depending on the properties desired at different regions of the article. In addition, the total volume of cemented carbide pieces and, if present, non-cemented carbide pieces may be varied to provide properties required of the article, although the total volume of cemented carbide pieces is at least 5%, or in other cases is at least 10%, of the article's total volume.

In non-limiting embodiments of the article, one or more cemented carbide pieces included in the article are composed of hybrid cemented carbide. As known to those having ordinary skill, cemented carbide is a composite material that typically includes a discontinuous phase of hard metal carbide particles dispersed throughout and embedded in a continuous metallic binder phase. As also known to those having ordinary skill, a hybrid cemented carbide comprises a discontinuous phase of hard particles of a first cemented carbide dispersed throughout and embedded in a continuous binder phase of a second cemented carbide grade. As such, a hybrid cemented carbide may be thought of as a composite of different cemented carbides.

The hard discontinuous phase of each cemented carbide included in a hybrid cemented carbide typically comprises a carbide of at least one of the transition metals, which are the elements found in Groups IVB, VB, and VIB of the Periodic Table. Transition metal carbides commonly included in hybrid cemented carbides include carbides of titanium, vanadium, chromium, zirconium, hafnium, molybdenum, niobium, tantalum, and tungsten. The continuous binder phase, which binds or "cements" together the metal carbide grains, typically is selected from cobalt, a cobalt alloy, nickel, a nickel alloy, iron, and an iron alloy. Additionally, one or more alloying elements such as, for example, tungsten, titanium, tantalum, niobium, aluminum, chromium, copper, manganese, molybdenum, boron, carbon, silicon, and ruthenium, may included in the continuous phase to enhance certain properties of the composites. In one non-limiting embodiment of an article according to the present disclosure, the article includes one or more pieces of a hybrid cemented carbide in which the binder concentration of the dispersed phase of the hybrid cemented carbide is 2 to 15 weight percent of the dispersed phase, and the binder concentration of the continuous binder phase of the hybrid cemented carbide is 6 to 30 weight percent of the continuous binder phase. Such an article optionally also includes one or more pieces of conventional cemented carbide material and one or more pieces of non-cemented carbide material. The one or more hybrid cemented carbide pieces, along with any conventional cemented carbide pieces and non-cemented carbide pieces are contacted by and bound within the article by a continuous joining phase that includes at least one of a metal and a metallic alloy. Each particular piece of cemented carbide or non-cemented carbide material may have a size and shape and is positioned at a desired predetermined position to provide various regions of the final article with desired properties.

The hybrid cemented carbides of certain non-limiting embodiments of articles according to the present disclosure may have relatively low contiguity ratios, thereby improving certain properties of the hybrid cemented carbides relative to other cemented carbides. Non-limiting examples of hybrid cemented carbides that may be used in embodiments of articles according to the present disclosure are found in U.S. Pat. No. 7,384,443, which is hereby incorporated by reference herein in its entirety. Certain embodiments of hybrid cemented carbide composites that may be included in articles herein have a contiguity ratio of the dispersed phase that is no greater than 0.48. In some embodiments, the contiguity ratio of the dispersed phase of the hybrid cemented carbide may be less than 0.4, or less than 0.2. Methods of forming hybrid cemented carbides having relatively low contiguity ratios and a metallographic technique for measuring contiguity ratios are detailed in the incorporated U.S. Pat. No. 7,384,443.

According to another aspect of the present disclosure, the article made according to the present disclosure includes one or more non-cemented carbide pieces bound in the article by the joining phase of the article. In certain embodiments, a non-cemented carbide piece included in the article is a solid metallic component consisting of a metallic material selected from iron, iron alloys, nickel, nickel alloys, cobalt, cobalt alloys, copper, copper alloys, aluminum, aluminum alloys, titanium, titanium alloys, tungsten, and tungsten alloys. In other non-limiting embodiments, a non-cemented carbide piece included in the article is a composite material including metal or metallic alloy grains, particles, and/or powder dispersed in a continuous metal or metal alloy matrix. In an embodiment, the continuous metal or metallic alloy matrix of the composite material of the non-cemented carbide piece is the matrix material of the joining phase. In certain non-limiting embodiments, a non-cemented carbide piece is a composite material including particles or grains of a metallic material selected from tungsten, a tungsten alloy, tantalum, a tantalum alloy, molybdenum, a molybdenum alloy, niobium, and a niobium alloy. In one particular embodiment, a non-cemented carbide piece included in an article according to the present disclosure comprises tungsten grains dispersed in a matrix of a metal or a metallic alloy. In certain embodiments, a non-cemented carbide piece included in an article herein may be machined to include threads or other features so that the article may be mechanically attached to another article.

According to one specific non-limiting embodiment of an article according to the present disclosure, the article is one of a fixed-cutter earth-boring bit and a roller cone earth-boring bit including a machinable non-cemented carbide piece bonded to the article by the joining phase, and wherein the non-cemented carbide piece is or may be machined to include threads or other features adapted to connect the bit to an earth-boring drill string. In certain specific embodiments, the machinable non-cemented carbide piece is made of a composite material including a discontinuous phase of tungsten particles dispersed and embedded within a matrix of bronze.

According to a non-limiting embodiment, the joining phase of an article according to the present disclosure, which binds the one or more cemented carbide pieces and, if present, the one or more non-cemented carbide pieces in the article, includes inorganic particles. The inorganic particles of the joining phase include, but are not limited to, hard particles that are at least one of a carbide, a boride, an oxide, a nitride, a silicide, a sintered cemented carbide, a synthetic diamond, and a natural diamond. In another non-limiting embodiment, the hard particles include at least one carbide of a metal selected from Groups IVB, VB, and VIB of the Periodic Table. In yet other non-limiting embodiments, the hard particles of the joining phase are tungsten carbide particles and/or cast tungsten carbide particles. As known to those having ordinary skill in the art, cast tungsten carbide particles are particles composed of a mixture of WC and $W_2C$, which may be a eutectic composition.

According to another non-limiting embodiment, the joining phase of an article according to the present disclosure, which binds the one or more cemented carbide pieces and, if present, the one or more non-cemented carbide pieces in the article includes inorganic particles that are one or more of metallic particles, metallic grains, and/or metallic powder. In certain non-limiting embodiments, the inorganic particles of the joining phase include particles or grains of a metallic material selected from tungsten, a tungsten alloy, tantalum, a tantalum alloy, molybdenum, a molybdenum alloy, niobium, and a niobium alloy. In one particular embodiment, inorganic particles in a joining phase according to the present disclosure comprise one or more of tungsten grains, particles, and/or powders dispersed in a matrix of a metal or a metallic alloy. In certain embodiments, the inorganic particles of the joining phase of an article herein are metallic particles, and the joining phase of an article is machinable and may be machined to include threads, bolt or screw holes, or other features so that the article may be mechanically attached to another article. In one embodiment according to the present disclosure, the article is an earth boring bit body and is machined or machinable to include threads, bolt and/or screw holes, or other attachment features so as to be attachable to an earth-boring drill string or other article of manufacture.

In another non-limiting embodiment, the joining phase of an article according to the present disclosure, which binds the one or more cemented carbide pieces and, if present, the one or more non-cemented carbide pieces in the article, includes inorganic particles that are a mixture of metallic particles and ceramic or other hard inorganic particles.

According to an aspect of this disclosure, in certain embodiments, the melting temperature of the inorganic particles of the joining phase is higher than the melting temperature of a matrix material of the joining phase, which binds together the inorganic particles in the joining phase. In a non-limiting embodiment, the inorganic hard particles of the joining phase have a higher melting temperature than the matrix material of the joining phase. In still another non-limiting embodiment, the inorganic metallic particles of the joining phase have a higher melting temperature than the matrix material of the joining phase.

The metallic matrix of the joining phase in some non-limiting embodiments of an article according to the present disclosure includes at least one of nickel, a nickel alloy, cobalt, a cobalt alloy, iron, an iron alloy, copper, a copper alloy, aluminum, an aluminum alloy, titanium, and a titanium alloy. In one embodiment, the metallic matrix is brass. In another embodiment, the metallic matrix is bronze. In one embodiment, the metallic matrix is a bronze comprising about 78 weight percent copper, about 10 weight percent nickel, about 6 weight percent manganese, about 6 weight percent tin, and incidental impurities.

According to certain non-limiting embodiments encompassed by the present disclosure, the article is one of a fixed-cutter earth-boring bit, a fixed-cutter earth-boring bit body, a roller cone for a rotary cone bit, or another part for an earth-boring bit.

Figure 3:
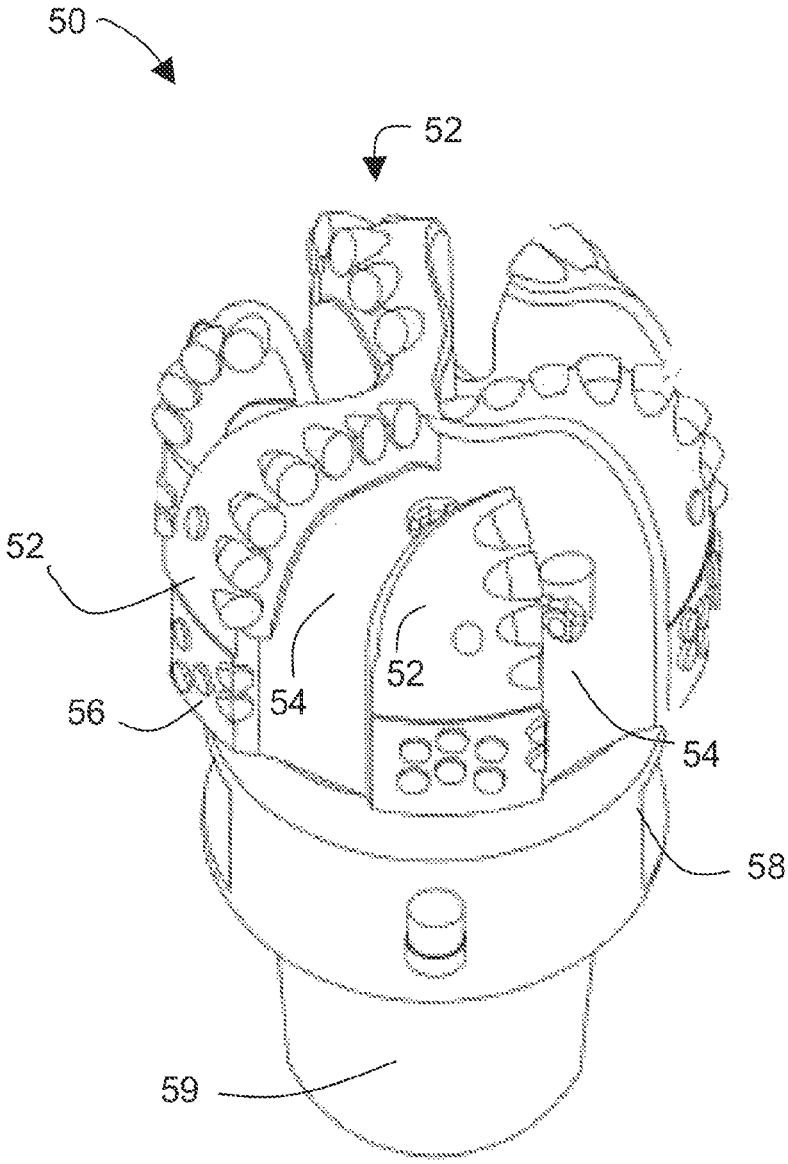
FIG. 3 is a schematic perspective view of a non-limiting embodiment of a fixed-cutter earth-boring bit according to the present disclosure.

One non-limiting aspect of the present disclosure is embodied in a fixed-cutter earth-boring bit 50 shown in FIG. 3. The fixed-cutter earth-boring bit 50 includes a plurality of blade regions 52 which are at least partially formed from sintered cemented carbide disposed in the void of the mold used to form the bit 50. In certain non-limiting embodiments, the total volume of sintered carbide pieces is at least about 5%, or may be at least about 10% of the total volume of the fixed-cutter earth-boring bit 50. Bit 50 further includes a metal matrix composite region 54. The metal matrix composite comprises hard particles dispersed in a metal or metallic alloy and joins to the cemented carbide pieces of the blade regions 52. The bit 50 is formed by methods according to the present disclosure. Although the non-limiting example depicted in FIG. 3 includes six blade regions 52 including six individual cemented carbide pieces, it will be understood that the number of blade regions and individual cemented carbide pieces included in the bit can be of any number. Bit 50 also includes a machinable attachment region 59 that is at least partially formed from a non-cemented carbide piece that was disposed in the void of the mold used to form the bit 50, and which is bonded in the bit by the metal matrix composite. According to one non-limiting embodiment, the non-cemented carbide piece included in the machinable attachment region includes a discontinuous phase of tungsten particles dispersed and embedded within a matrix of bronze.

It is known that some regions of an earth-boring bit are subjected to a greater degree of stress and/or abrasion than other regions on the earth-boring bit. For example, the blade regions of certain fixed-cutter earth-boring bit onto which polycrystalline diamond compact (PDC) inserts are attached are typically subject to high shear forces, and shear fracture of the blade regions is a common mode of failure in PDC-based fixed-cutter earth-boring bits. Forming the bit bodies of solid cemented carbide provides strength to the blade regions, but the blade regions may distort during sintering. Distortions of this type can result in incorrect positioning of the PDC cutting inserts on the blade regions, which can cause premature failure of the earth-boring bit. Certain embodiments of earth-boring bit bodies embodied within the present disclosure do not suffer from the risks for distortion suffered by certain cemented carbide bit bodies. Certain embodiments of bit bodies according to the present disclosure also do not suffer from the difficulties presented by the need to machine solid cemented carbide compacts to form bits of complex shapes from the compacts. In addition, in certain known solid cemented carbide bit bodies, expensive cemented carbide material is included in regions of the bit body that do not require the strength and abrasion resistance of the blade regions.

In fixed-cutter earth-boring bit 50 of FIG. 3, the blade regions 52, which are highly stressed and subject to substantial abrasive forces, are composed entirely or principally of strong and highly abrasion resistant cemented carbide, while regions of the bit 50 separating the blade regions 54, which are regions in which strength and abrasion resistance are less critical, may be constructed from conventional infiltrated metal matrix composite materials. The metal matrix composite regions 54 are bonded directly to the cemented carbide within the blade regions 52. In certain non-limiting embodiments, gage pads 56 and mud nozzle regions 58 also may be constructed of cemented carbide pieces that are disposed in the mold void used to form the bit 50. More generally, any region of the bit 50 that requires substantial strength, hardness, and/or wear resistance may include at least portions composed of cemented carbide pieces positioned within the mold and which are bonded into the bit 50 by the infiltrated metal matrix composite.

In non-limiting embodiments of an earth-boring bit or bit part according to the present disclosure, the at least one cemented carbide piece or region comprises at least one carbide of a metal selected from Groups IVB, VB, and VIB of the Periodic Table, and a binder comprising one or more of cobalt, a cobalt alloy, nickel, a nickel alloy, iron, and an iron alloy. In other embodiments, the binder of the cemented carbide region includes at least one additive selected from chromium, silicon, boron, aluminum, copper, ruthenium, and manganese.

The cemented carbide portions of an earth-boring bit according to the present disclosure may include hybrid cemented carbide. In certain non-limiting embodiments, the hybrid cemented carbide composite has a contiguity ratio of a dispersed phase that is less than or equal to 0.48, less than 0.4, or less than 0.2.

In an additional embodiment, an earth-boring bit may include at least one non-cemented carbide region. The non-cemented carbide region may be a solid metallic region composed of at least one of iron, an iron alloy, nickel, a nickel alloy, cobalt, a cobalt alloy, copper, a copper alloy, aluminum, an aluminum alloy, titanium, a titanium alloy, tungsten, and a tungsten alloy. In other embodiments of an earth-boring bit according to the present disclosure, the at least one metallic region includes metallic grains dispersed in a metallic matrix, thereby providing a metal matrix composite. In a non-limiting embodiment, the metal grains may be selected from tungsten, a tungsten alloy, tantalum, a tantalum alloy, molybdenum, a molybdenum alloy, niobium, and a niobium alloy. In another non-limiting embodiment of a fixed-cutter earth-boring bit having a non-cemented carbide region that is a metal matrix composite including metallic grains embedded in a metal or a metallic alloy, the metal or metallic alloy of the metallic matrix region also is the is the same as that of the matrix material of the joining phase binding the at least one cemented carbide piece into the article.

According to certain embodiments, an earth-boring bit includes a machinable metallic region, which is machined to include threads or other features to thereby provide an attachment region for attaching the bit to a drill string or other structure.

In another non-limiting embodiment, the hard particles in the metallic matrix composite from which the non-cemented carbide region is formed includes hard particles of at least one of a carbide, a boride, an oxide, a nitride, a silicide, a sintered cemented carbide, a synthetic diamond, and a natural diamond. For examples, the hard particles include at least one carbide of a metal selected from Groups IVB, VB, and VIB of the Periodic Table. In certain embodiments, the hard particles are tungsten carbide and/or cast tungsten carbide.

The metallic matrix of the metal matrix composite may include, for example, at least one of nickel, a nickel alloy, cobalt, a cobalt alloy, iron, an iron alloy, copper, a copper alloy, aluminum, an aluminum alloy, titanium, and a titanium alloy. In embodiments, the matrix is a brass alloy or a bronze alloy. In one embodiment, the matrix is a bronze alloy that consists essentially of about 78 weight percent copper, about 10 weight percent nickel, about 6 weight percent manganese, about 6 weight percent tin, and incidental impurities.

Figure 4:
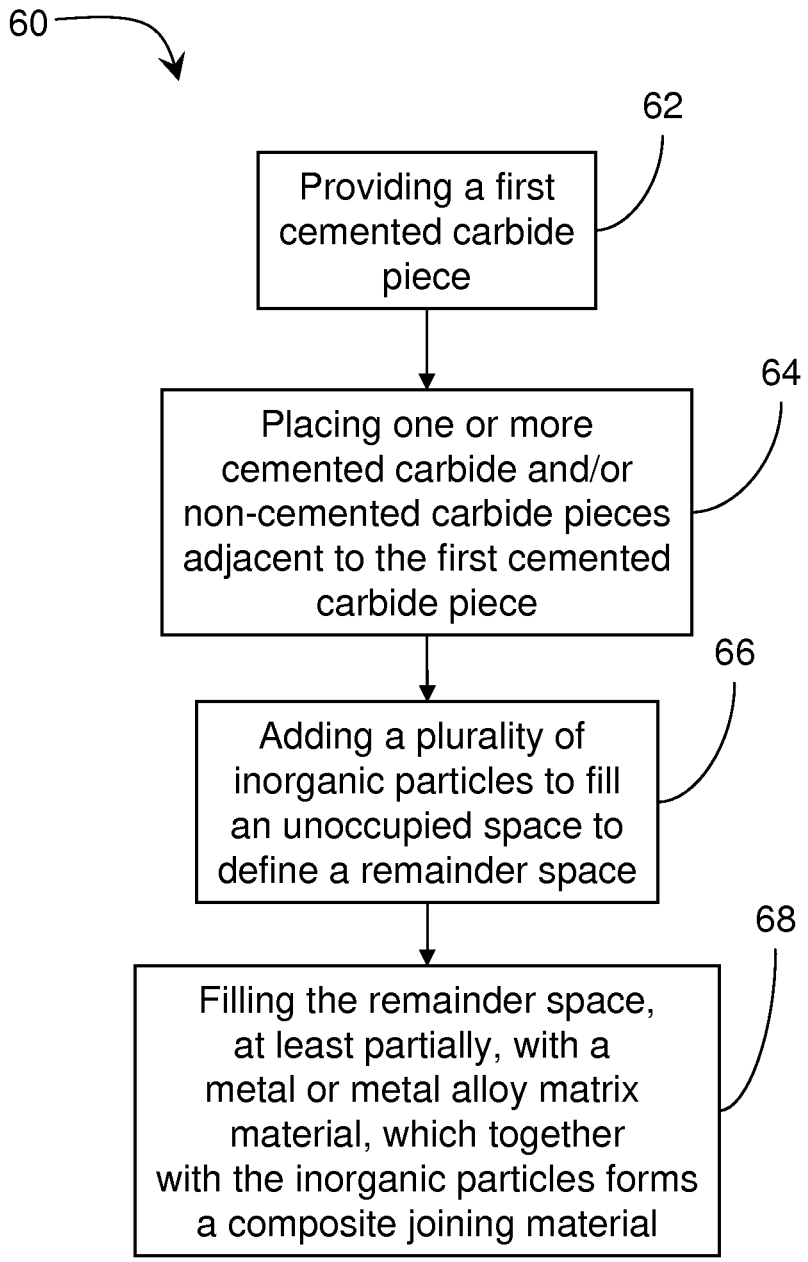
FIG. 4 is a flow chart summarizing one non-limiting embodiment of a method of making complex articles of manufacture including cemented carbide according to the present disclosure.

Referring now to the flow diagram of FIG. 4, according to one aspect of this disclosure, a method for forming an article 60 comprises providing a cemented carbide piece (step 62), and placing one or more cemented carbide pieces and/or non-cemented carbide pieces adjacent to the first cemented carbide (step 64). In non-limiting embodiments, the total volume of the cemented carbide pieces placed in the mold is at least 5%, or may be at least 10%, of the total volume of the article made in the mold. The pieces may be positioned within the void of a mold, if desired. The space between the various pieces defines an unoccupied space. A plurality of inorganic particles are added at least a portion of the unoccupied space (step 66). The remaining void space between the plurality of inorganic particles and the various cemented carbide and non-cemented carbide pieces define a remainder space. The remainder space is at least partially filled with a metal or metal alloy matrix material (step 68) which, together with the inorganic particles, forms a composite joining material. The joining material bonds together the inorganic particles and the one or more cemented carbide and, if present, non-cemented carbide pieces.

According to one non-limiting aspect of this disclosure, the remainder space is filled by infiltrating the remainder space with a molten metal or metal alloy. Upon cooling and solidification, the metal or metal alloy binds the cemented carbide piece, the non-cemented carbide piece, if present, and the inorganic particles to form the article of manufacture. In a non-limiting embodiment, a mold containing the pieces and the inorganic particles is heated to or above the melting temperature of the metal or metal alloy infiltrant. In a non-limiting embodiment, infiltration occurs by pouring or casting the molten metal or metal alloy into the heated mold until at least a portion of the remainder space is filled with the molten metal or metal alloy.

An aspect of a method of this disclosure is to use a mold to manufacture the article. The mold may consist of graphite or any other chemically inert and temperature resistant material known to a person having ordinary skill in the art. In a non-limiting embodiment, at least two cemented carbide pieces are positioned in the void at predetermined positions. Spacers may be placed in the mold to position at least one of the cemented carbide pieces and, if present, the non-cemented carbide pieces in the predetermined positions. The cemented carbide pieces may be positioned in a critical area, such as, but not limited to, a blade portion of an earth-boring bit requiring high strength, wear resistance, hardness, or the like.

In a non-limiting embodiment, the cemented carbide piece is composed of at least one carbide of a Group IVB, a Group VB, or a Group VIB metal of the Periodic Table; and a binder composed of one or more of cobalt, cobalt alloys, nickel, nickel alloys, iron, and iron alloys. In some embodiments, the binder of the cemented carbide piece contains an additive selected from the group consisting of chromium, silicon, boron, aluminum, copper ruthenium, manganese, and mixtures thereof. The additive may include up to 20 weight percent of the binder.

In other non-limiting embodiments, the cemented carbide piece comprises a hybrid cemented carbide composite. In some embodiments, a dispersed phase of the hybrid cemented carbide composite has a contiguity ratio of 0.48 or less, less than 0.4, or less than 0.2.

Without limitation, a non-cemented carbide piece may be positioned in the mold at a predetermined position. In non-limiting embodiments, the non-cemented carbide piece is a metallic material composed of at least one of a metal and a metallic alloy. In further non-limiting embodiments, the metal includes at least one of iron, an iron alloy, nickel, a nickel alloy, cobalt, a cobalt alloy, copper, a copper alloy, aluminum, an aluminum alloy, titanium, a titanium alloy, tungsten and a tungsten alloy.

In another non-limiting embodiment, a plurality of metal grains, particles, and/or powders are added to a portion of the mold. The plurality of metal grains contribute, together with the plurality of inorganic particles, to define the remainder space, which is subsequently infiltrated by the molten metal or metal alloy. In some non-limiting embodiments, the metal grains include at least one of tungsten, a tungsten alloy, tantalum, a tantalum alloy, molybdenum, a molybdenum alloy, niobium, and a niobium alloy. In a specific embodiment, the metal grains are composed of tungsten.

In a non-limiting embodiment, the inorganic particles partially filling the unoccupied space are hard particles. In embodiments, hard particles include one or more of a carbide, a boride, an oxide, a nitride, a silicide, a sintered cemented carbide, a synthetic diamond, or a natural diamond. In another non-limiting embodiment, the hard particles comprise at least one carbide of a metal selected from Groups IVB, VB, and VIB of the Periodic Table. In other specific embodiments, the hard particles are selected to be composed of tungsten carbide and/or cast tungsten carbide.

In another non-limiting embodiment, the inorganic particles partially filling the unoccupied space are metallic grains, particles and/or powders. The metal grains define the remainder space, which is subsequently infiltrated by the molten metal or metal alloy. In some non-limiting embodiments, the metal grains include at least one of tungsten, a tungsten alloy, tantalum, a tantalum alloy, molybdenum, a molybdenum alloy, niobium, and a niobium alloy. In a specific embodiment, the metal grains are composed of tungsten.

The molten metal or metal alloy used to infiltrate the remainder space include, but are not limited to, one or more of nickel, a nickel alloy, cobalt, a cobalt alloy, iron, an iron alloy, copper, a copper alloy, aluminum, an aluminum alloy, titanium, a titanium alloy, a bronze, and a brass. It is often useful from a process standpoint to use an infiltrating molten metal or metal alloy that has a relatively low melting temperature. Thus, alloys of brass or bronze are employed in non-limiting embodiments of the molten metal or metal alloy used to infiltrate the remainder space. In a specific embodiment, a bronze alloy composed of 78 weight percent copper, 10 weight percent nickel, 6 weight percent manganese, 6 weight percent tin, and incidental impurities is selected as the infiltrating molten metal or metal alloy.

According to aspects of embodiments of methods for manufacturing an article of manufacture containing cemented carbides, disclosed herein, an article of manufacture may include, but is not limited to, a fixed-cutter earth-boring bit body and a roller cone of a rotary cone bit.

According to another aspect of this disclosure, a method of manufacturing a fixed-cutter earth-boring bit is disclosed. A method for manufacturing a fixed-cutter earth-boring bit includes positioning at least one sintered cemented carbide piece and, optionally, at least one non-cemented carbide piece into a mold, thereby defining an unoccupied portion of a void in the mold. In non-limiting embodiments, the total volume of the cemented carbide pieces placed in the mold is 5% or greater, or 10% or greater, than the total volume of the fixed-cutter earth-boring bit. Hard particles are disposed in the unoccupied portion of the mold to occupy a portion of the unoccupied portion of the void, and to define an unoccupied remainder portion of the void of the mold. The unoccupied remainder portion of the void is, generally the space between the hard particles, and the space between the hard particles and the individual pieces in the mold. The mold is heated to a casting temperature. A molten metallic casting material is added to the mold. The casting temperature is a temperature at or above the melting temperature of the metallic casting material. Typically, the metallic casting temperature is at or near the melting temperature of the metallic casting material. The molten metallic casting material infiltrates the unoccupied remainder portion. The mold is cooled to solidify the metallic casting material and bind the at least one sintered cemented carbide piece, the non-cemented carbide piece, if present, and the hard particles, thus forming a fixed-cutter earth-boring bit. In a non-limiting embodiment, the cemented carbide piece is positioned within the void of the mold to form at least a part of a blade region of the fixed-cutter earth-boring bit. In another non-limiting embodiment, the non-cemented carbide piece, when present, forms at least a part of an attachment region of the fixed-cutter earth-boring bit.

In an embodiment, at least one graphite spacer, or a spacer made from another inert material, is positioned in the void of the mold. The void of the mold and the at least one graphite spacer, if present, define an overall shape of the fixed-cutter earth-boring bit.

In some embodiments, when a non-cemented carbide piece composed of a metallic material is disposed in the void, the non-cemented carbide metallic piece forms a machinable region of the fixed-cutter earth-boring bit. The machinable region typically is threaded to facilitate attaching the fixed-cutter earth-boring bit to the distal end of a drill string. In other embodiments, other types of mechanical fasteners, such as but not limited to grooves, tongues, hooks and the like, may be machined into the machinable region to facilitate fastening of the earth-boring bit to a tool, tool holder, drill string or the like. In non-limiting embodiments, the machinable region includes at least one of iron, an iron alloy, nickel, a nickel alloy, cobalt, a cobalt alloy, copper, a copper alloy, aluminum, an aluminum alloy, titanium, a titanium alloy, tungsten and a tungsten alloy.

Another process for incorporating a machinable region into the earth-boring bit is by disposing hard inorganic particles into the void in the form of metallic grains. In a non-limiting embodiment, the metallic grains are added only to a portion of the void of the mold. The metallic grains define an empty space in between the metallic grains. When the molten metallic casting material is added to the mold, the molten metallic casting material infiltrates the empty space between the metal grains to form metal grains in a matrix of solidified metallic casting material, thus forming a machinable region on the earth-boring bit. In non-limiting embodiments, the metal grains include at least one or more of tungsten, a tungsten alloy, tantalum, a tantalum alloy, molybdenum, a molybdenum alloy, niobium, and a niobium alloy. In a specific embodiment, the metal grains are tungsten. Another non-limiting embodiment includes threading the machinable region.

Typically, but not necessarily, the at least one sintered cemented carbide piece is composed of at least one carbide of a metal selected from Groups IVB, VB, and VIB of the Periodic Table, and a binder that includes at least one of cobalt, a cobalt alloy, nickel, a nickel alloy, iron, and an iron alloys. The binder can include up to 20 weight percent of an additive selected from the group consisting of chromium, silicon, boron, aluminum, copper ruthenium, manganese, and mixtures thereof. In another non-limiting embodiment, the at least one sintered cemented carbide makes up a minimum of 10 percent by volume of the earth-boring bit. In yet another embodiment, the at least one sintered cemented carbide includes a sintered hybrid cemented carbide composite. In embodiments, the hybrid cemented carbide composite has a contiguity ratio of a dispersed phase that is less than or equal to 0.48, or less than 0.4, or less than 0.2.

It may be desirable to have other areas of increased strength and wear resistance on an earth-boring bit, for example, but not limited to, in areas of a gage plate or a nozzle or an area around a nozzle. A non-limiting embodiment includes positioning at least one cemented carbide gage plate into the mold. Another non-limiting embodiment includes positioning at least one cemented carbide nozzle or nozzle region into the mold.

According to embodiments, hard inorganic particles typically include at least one of a carbide, a boride, and oxide, a nitride, a silicide, a sintered cemented carbide, a synthetic diamond, and a natural diamond. In other non-limiting embodiments, the hard inorganic particles include at least one of a carbide of a metal selected from Groups IVB, VB, and VIB of the Periodic Table; tungsten carbide; and cast tungsten carbide.

The metallic casting material may include at least one of nickel, a nickel alloy, cobalt, a cobalt alloy, iron, an iron alloy, copper, a copper alloy, aluminum, an aluminum alloy, titanium, a titanium alloy, a bass and a bronze. In other embodiments the metallic casting material comprises a bronze. In a specific embodiment, the bronze consists essentially of 78 weight percent copper, 10 weight percent nickel, 6 weight percent manganese, 6 weight percent tin, and incidental impurities.

After all of the sintered cemented carbide pieces, the non-cemented carbide pieces, if present, metallic hard inorganic particles, if present, and spacers are added to the mold, hard inorganic particles are added into the mold to a predetermined level. The predetermined level is determined by the particular engineering design of the earth-boring bit. The predetermined level for a particular engineering design is known to a person having ordinary skill in the art. In a non-limiting embodiment, the hard particles are added to just below the height of the cemented carbide pieces positioned in the area of a blade in the mold. In other non-limiting embodiments, the hard particles are added to be level with, or to be above, the height of the cemented carbide pieces in the mold.

As defined above, a casting temperature is typically a temperature at or above the melting temperature of the metallic casting material that is added to the mold. In a specific embodiment where the metallic casting material is a bronze alloy composed of 78 weight percent copper, 10 weight percent nickel, 6 weight percent manganese, 6 weight percent tin, and incidental impurities, the casting temperature is 1180° C.

The mold and the contents of the mold are cooled. Upon cooling, the metallic casting material solidifies and bonds together the sintered cemented carbide pieces; any non-cemented carbide pieces; and the hard particles into a composite fixed-cutter earth-boring bit. After removal from the mold, the fixed-cutter earth-boring bit can be finished by adding PDC inserts, machining the surfaces to remove excess metal matrix joining material, and any other finishing practice known to one having ordinary skill in the art to finish the molded product into a finished earth-boring bit.

According to another aspect of this disclosure, an article of manufacture includes at least one cemented carbide piece, and a joining phase composed of a eutectic alloy material binding the at least one cemented carbide piece into the article of manufacture. In some embodiments, the at least one cemented carbide piece has a cemented carbide volume that is at least 5%, or at least 10%, of a total volume of the article of manufacture. In non-limiting embodiments, at least one non-cemented carbide piece is bound into the article of manufacture by the joining phase.

According to certain embodiments, the at least one cemented carbide piece joined with the eutectic alloy material may comprise hard inorganic particles of at least one carbide of a metal selected from Groups IVB, VB, and VIB of the Periodic Table, dispersed in a binder comprising at least one of cobalt, a cobalt alloy, nickel, a nickel alloy, iron, and an iron alloy. In non-limiting embodiments, the binder of the cemented carbide piece includes at least one additive selected from chromium, silicon, boron, aluminum, copper, ruthenium, and manganese.

In an embodiment, the at least one cemented carbide piece includes a hybrid cemented carbide, and in another embodiment, the dispersed phase of the hybrid cemented carbide has a contiguity ratio no greater than 0.48.

In certain embodiments, the at least one cemented carbide piece is joined within the article by a eutectic alloy material, and the article includes at least one non-cemented carbide piece that is a metallic component. The metallic component may comprise, for example, at least one of iron, an iron alloy, nickel, a nickel alloy, cobalt, a cobalt alloy, copper, a copper alloy, aluminum, an aluminum alloy, titanium, a titanium alloy, tungsten, and a tungsten alloy.

In a specific embodiment, the eutectic alloy material is composed of 55 weight percent nickel and 45 weight percent tungsten carbide. In another specific embodiment, the eutectic alloy material is composed of 55 weight percent cobalt and 45 weight percent tungsten carbide. In other embodiments, the eutectic alloy component may be any eutectic composition, known now or hereafter to one having ordinary skill in the art, which upon solidification phase separates into a solid material composed of metallic grains interspersed with hard phase grains.

In non-limiting embodiments, the article of manufacture is one of a fixed-cutter earth-boring bit body, a roller cone, and a part for an earth-boring bit.

Another method of making an article of manufacture that includes cemented carbide pieces consists of placing a cemented carbide piece next to at least one adjacent piece. A space between the cemented carbide piece and the adjacent piece defines a filler space. In a non-limiting embodiment, the cemented carbide piece and the adjacent piece are chamfered and the chamfers define the filler space. A powder that consists of a metal alloy eutectic composition is added to the filler space. The cemented carbide piece, the adjacent piece, and the powder are heated to at least the eutectic melting point of the metal alloy eutectic composition where the powder melts. After cooling the solidified metal alloy eutectic composition joins the cemented carbide component and the adjacent component.

In a non-limiting embodiment, placing the cemented carbide piece next to at least one adjacent piece includes placing the sintered cemented carbide piece next to another sintered cemented carbide piece.

In another non-limiting embodiment, placing the cemented carbide piece next to at least one adjacent piece includes placing the sintered cemented carbide piece next to a non-cemented carbide piece. The non-cemented carbide piece may include, but is not limited to, a metallic piece.

In a specific embodiment, adding a blended powder includes adding a blended powder comprising about 55 weight percent nickel and about 45 weight percent tungsten carbide. In another specific embodiment, adding a blended powder includes adding a blended powder comprising about 55 weight percent cobalt and about 45 weight percent tungsten carbide. In other embodiments, adding a blended powder includes adding any eutectic composition, known now or hereafter to one having ordinary skill in the art, which upon solidification forms a material comprising metallic grains interspersed with hard phase grains.

In embodiments wherein the blended powder comprises about 55 weight percent nickel and about 45 weight percent tungsten carbide, heating the cemented carbide piece, the adjacent piece, and the powder to at least a eutectic melting point of the metal alloy eutectic composition includes heating to a temperature of 1350° C. or greater. In non-limiting embodiments, heating the cemented carbide piece, the adjacent piece, and the powder to at least a eutectic melting point of the metallic alloy eutectic composition includes heating in an inert atmosphere or a vacuum.

EXAMPLE 1

Figure 5:
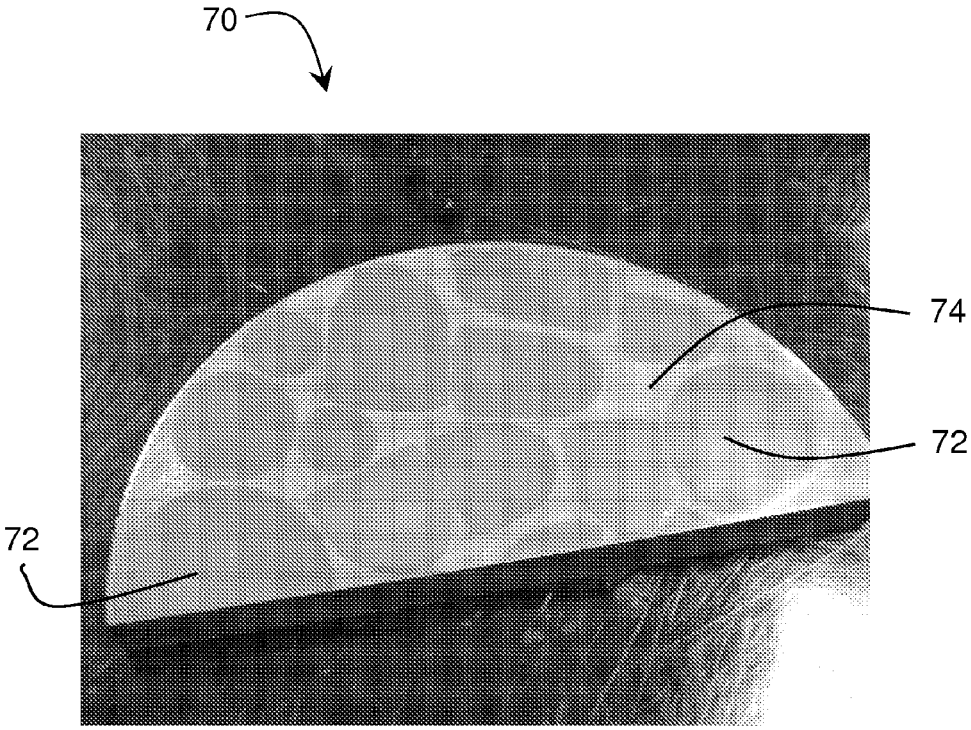
FIG. 5 is a photograph of a section through an article of manufacture including cemented carbide made by a non-limiting embodiment of a method according to the present disclosure.

FIG. 5 is a photograph of a composite article 70 made according to embodiments of a method of the present disclosure. The article 70 includes several individual sintered cemented carbide pieces 72 bonded together by a joining phase 74 comprising hard inorganic particles dispersed in a metallic matrix. The individual sintered cemented carbide pieces 72 were fabricated by conventional techniques. The cemented carbide pieces 72 were positioned in a cylindrical graphite mold, and an unoccupied space was defined between the pieces 72. Cast tungsten carbide particles were placed in the unoccupied space, a remainder space existed between the individual tungsten carbide particles. The mold containing the cemented carbide pieces 72 and the cast tungsten carbide particles was heated to a temperature of 1180° C. A molten bronze was introduced into the void of the mold and infiltrated the remainder space, binding together the cemented carbide pieces and the cast tungsten carbide particles. The composition of the bronze was 78% (w/w) copper, 10% (w/w) nickel, 6% (w/w) manganese, and 6%(w/w) tin. The bronze was cooled and solidified, forming a metal matrix composite of the cast tungsten carbide particles embedded in solid bronze.

Figure 6A:
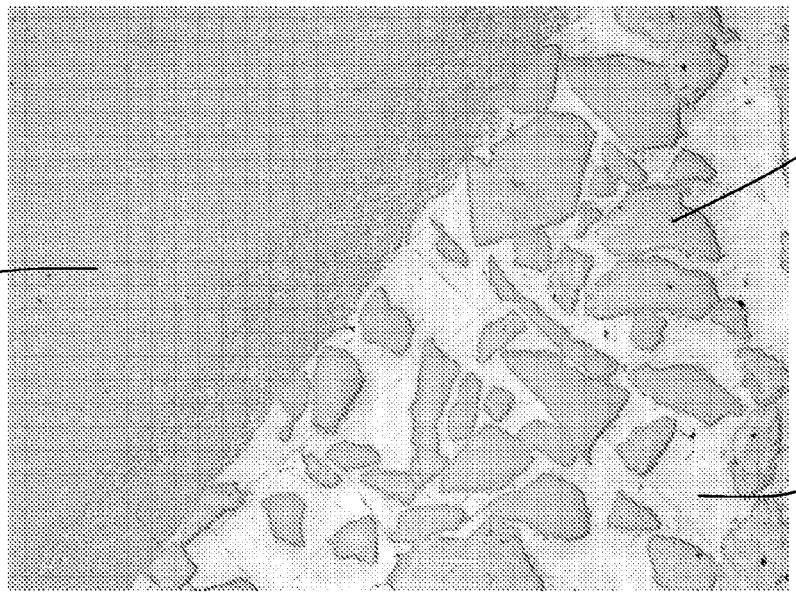
FIGS. 6A and 6B are low magnification and high magnification photomicrographs, respectively, of an interfacial region between a sintered cemented carbide piece and a composite matrix including cast tungsten carbide particles embedded in a continuous bronze phase in an article of manufacture made by a non-limiting embodiment of a method according to the present disclosure.
Figure 6B:
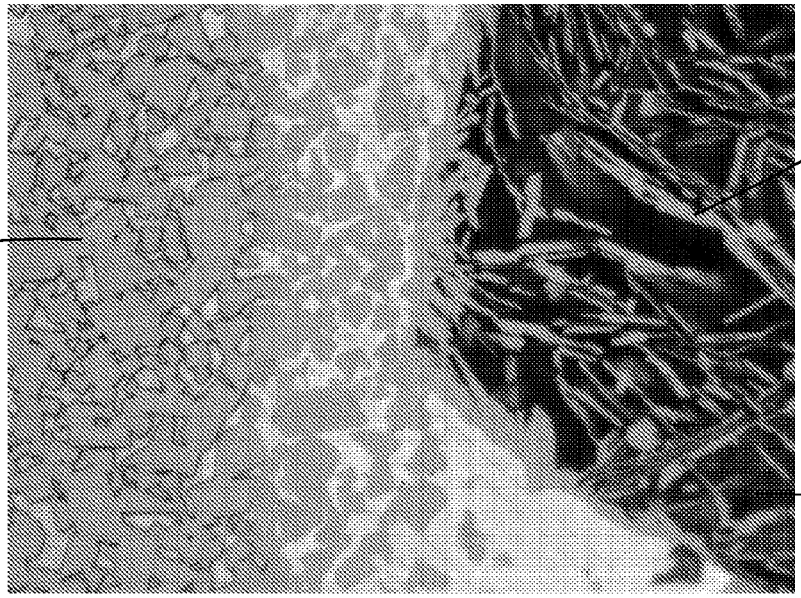

Photomicrographs of the interfacial region between a cemented carbide piece 72 and the metal matrix composite 74, comprising the cast tungsten carbide particles 75 in the bronze matrix 76, of the article 60 are shown in FIG. 6A (low magnification) and FIG. 6B (higher magnification). Referring to FIG. 6B, the infiltration process resulted in a distinct interfacial zone 78 that appears to include bronze casting material dissolved in an outer layer of the cemented carbide piece 62, where the bronze mixed with the binder phase of the cemented carbide piece 62. In general, it is believed that interfacial zones exhibiting the form of diffusion bonding shown in FIG. 6B exhibit strong bond strengths.

EXAMPLE 2

Figure 7:
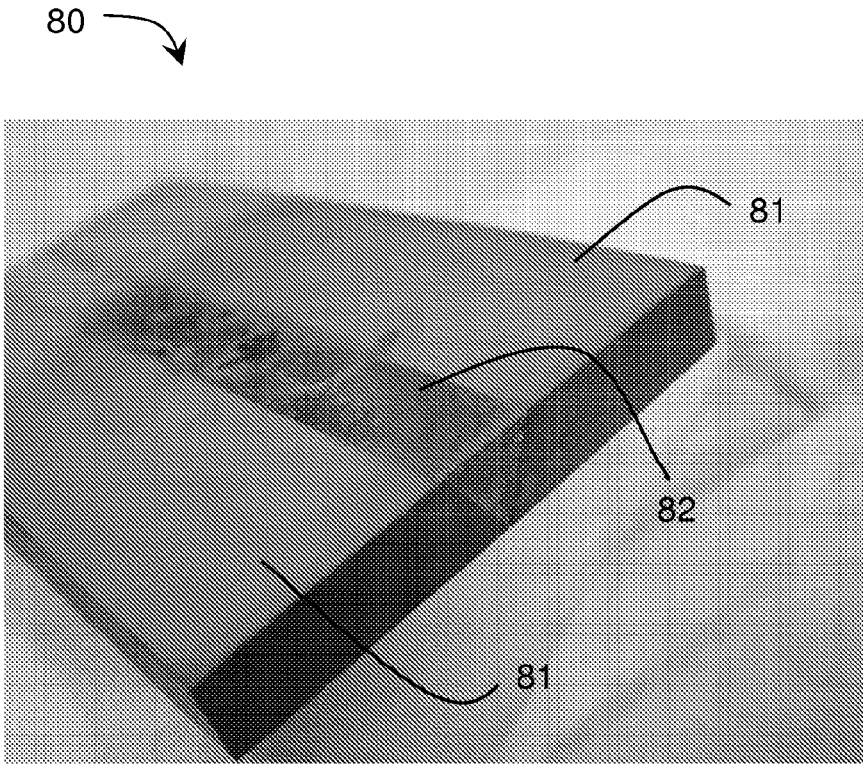
FIG. 7 is a photograph of a non-limiting embodiment of an article of manufacture including cemented carbide pieces joined together by a eutectic alloy of nickel and tungsten carbide according to the present disclosure.

FIG. 7 is a photograph of an additional composite article 80 made according to embodiments of a method of the present disclosure. Article 80 comprises two sintered cemented carbide pieces 81 bonded in the article 80 by a Ni—WC alloy 82 having a eutectic composition. The article 80 was made by disposing a powder blend consisting of 55% (w/w) nickel powder and 45% (w/w) tungsten carbide powder in a chamfered region between the two cemented carbide pieces 81. The assembly was heated in a vacuum furnace at a temperature of 1350° C. which was above the melting point of the powder blend. The molten material was cooled and solidified in the chamfered region as the Ni—WC alloy 82, bonding together the cemented carbide pieces 81 to form the article 80.

EXAMPLE 3

Figure 8:
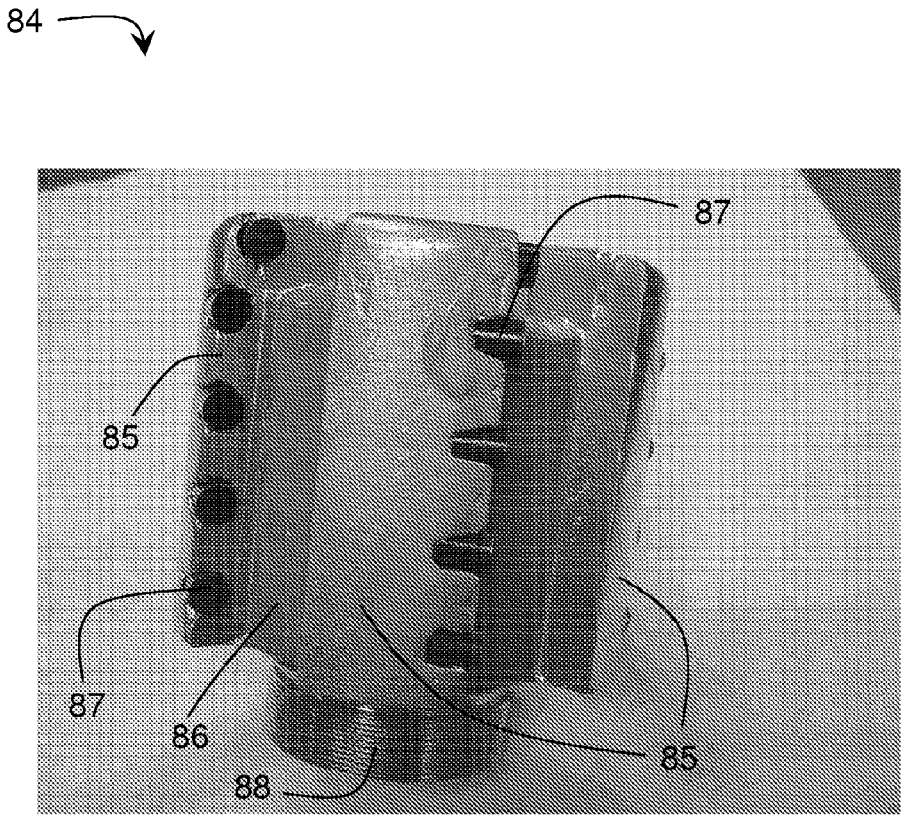
FIG. 8 is a photograph of a non-limiting embodiment of a fixed-cutter earth-boring bit according to the present disclosure.

FIG. 8 is a photograph of a fixed-cutter earth-boring bit 84 according to a non-limiting embodiment according of the present disclosure. The fixed-cutter earth-boring bit 84 includes sintered cemented carbide pieces forming blade regions 85 bound into the bit 84 by a first metallic joining material 86 including cast tungsten carbide particles dispersed in a bronze matrix. Polycrystalline diamond compacts 87 were mounted in insert pockets defined within the sintered cemented carbide pieces forming the blade regions 85. A non-cemented carbide piece also was bonded into the bit 84 by a second metallic joining material and formed a machinable attachment region 88 of the bit 84. The second joining material was a metallic composite including tungsten powder (or grains) dispersed in a bronze casting alloy.

Figure 9:
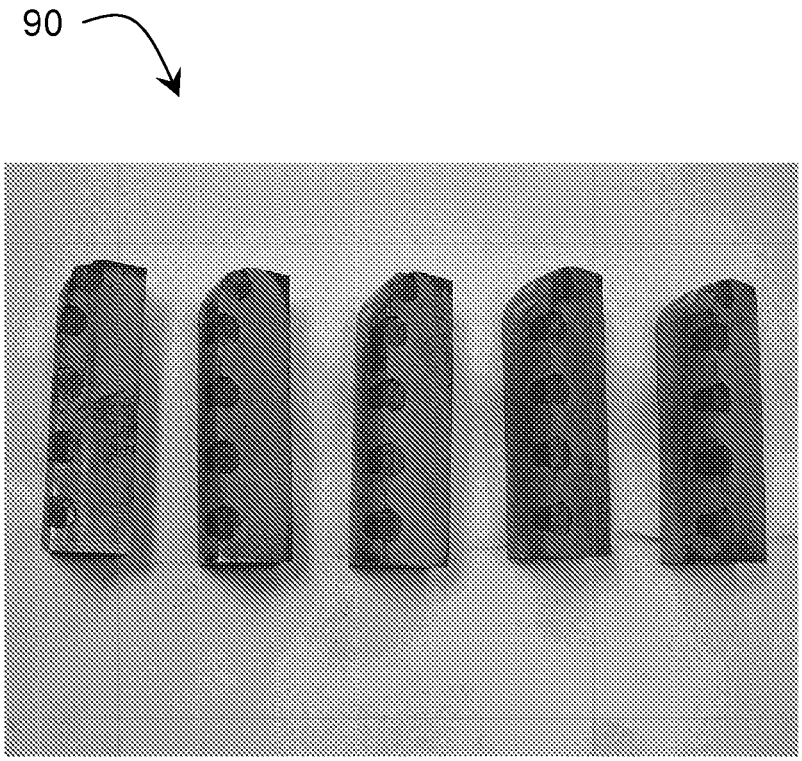
FIG. 9 is a photograph of sintered cemented carbide blade pieces incorporated in the fixed-cutter earth-boring bit shown in FIG. 8.
Figure 10:
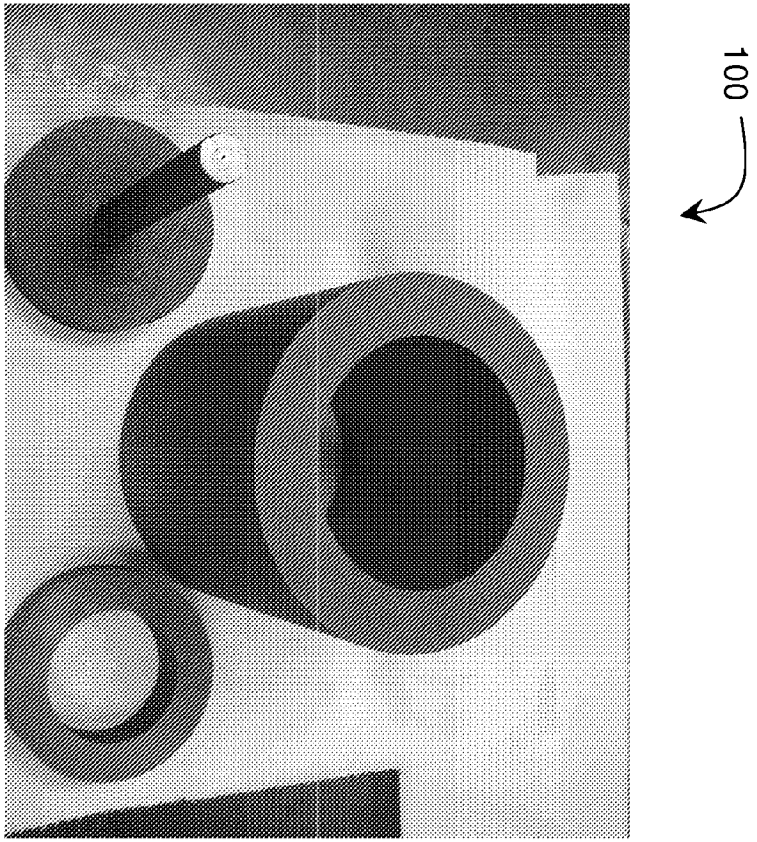
FIG. 10 is a photograph of the graphite mold and mold components used to fabricate the earth-boring bit depicted in FIG. 8 using the cemented carbide blade pieces shown in FIG. 9 and the graphite spacers shown in FIG. 11.
Figure 11:
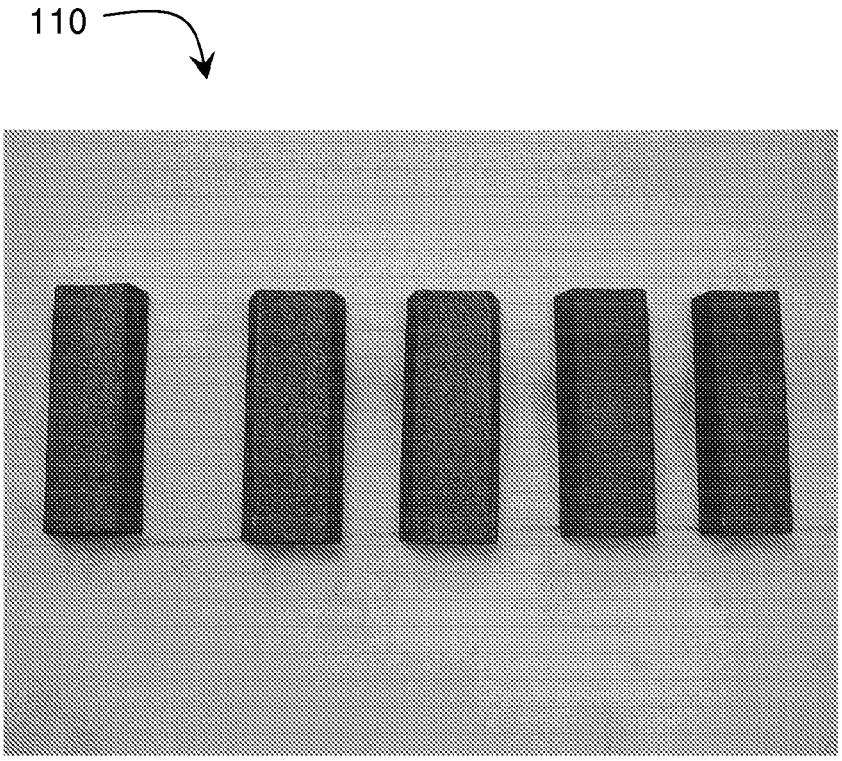
FIG. 11 is a photograph of graphite spacers used to fabricate the earth-boring bit depicted in FIG. 8.
Figure 12:
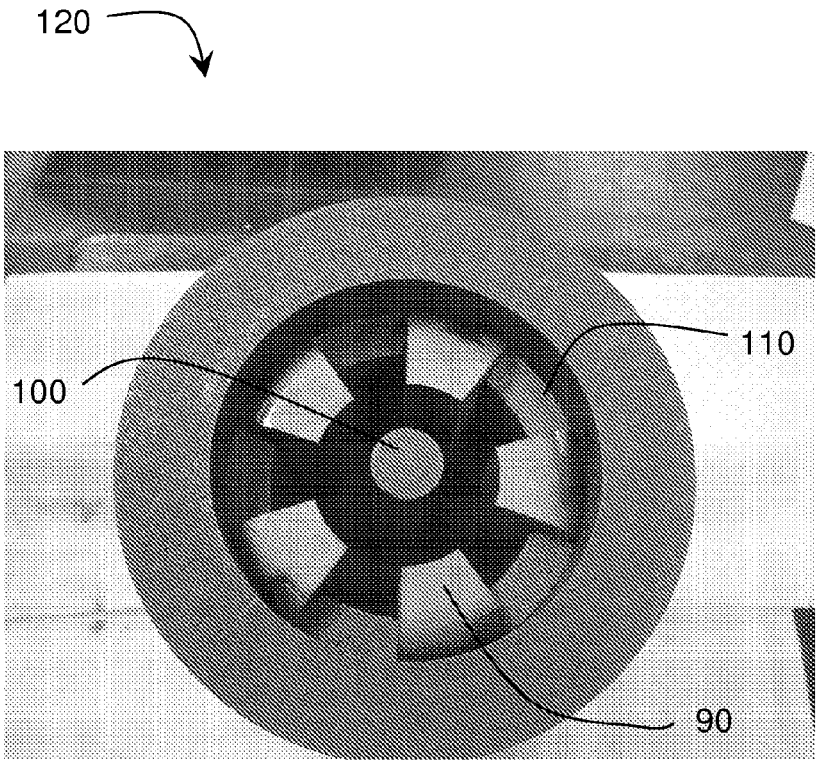
FIG. 12 is a photograph depicting a top view of the assembled mold assembly that was used to make the fixed-cutter earth-boring bit depicted in FIG. 8.

Referring now to FIGS. 8-12, the fixed-cutter earth-boring bit 84 illustrated in FIG. 8 was fabricated as follows. FIG. 9 is a photograph of sintered cemented carbide pieces 90 included in the bit 84, which formed the blade regions 85. The sintered cemented carbide pieces 90 were made using conventional powder metallurgy techniques including steps of powder compaction, machining the compact in a green and/or brown (i.e. presintered) condition, and high temperature sintering The graphite mold and mold components 100 used to fabricate the earth-boring bit 84 of FIG. 8 are shown in FIG. 10. Graphite spacers 110 that were placed in the mold are shown in FIG. 11. The sintered cemented carbide blades 90, graphite spacers 110, and other graphite mold components 100 were positioned in the mold. FIG. 12 is a view looking into the void of the mold and showing the positioning of the various components to provide the final mold assembly 120. Crystalline tungsten powder was first introduced into a region of the void space in the mold assembly 120 to form a discontinuous phase of the machinable attachment region 88 of the bit 84. Cast tungsten carbide particles were then poured into the unoccupied void space of the mold assembly 120 to a level just below the height of the cemented carbide pieces 90. A graphite funnel (not shown) was disposed on top of the mold assembly 120 and bronze pellets were placed in the funnel. The entire assembly 120 was placed in a preheated furnace with an air atmosphere at a temperature of 1180° C. and heated for 60 minutes. The bronze pellets melted and the molten bronze infiltrated the crystalline tungsten powder to form the machinable region of metal grains in the casting metal matrix, and infiltrated the tungsten carbide particles to form the metallic composite joining material. The resulting earth-boring bit 84 was cleaned and excess material was removed by machining. Threads were machined into the attachment region 88.

Figure 13:
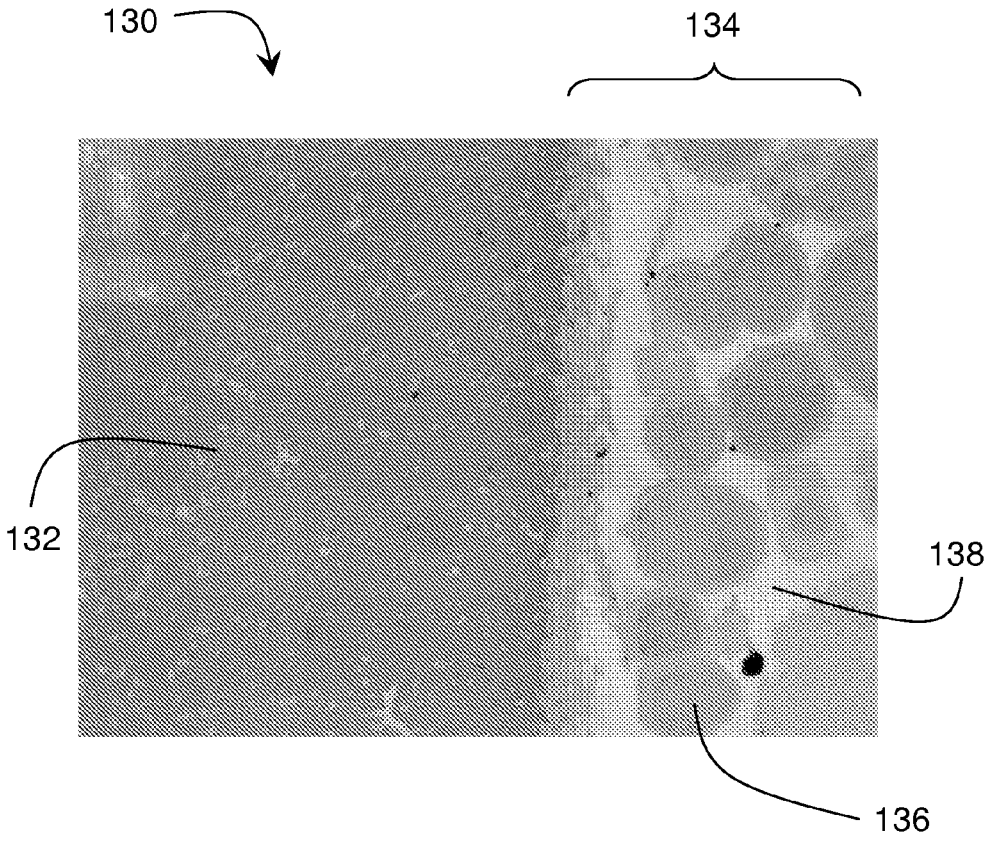
FIG. 13 is a photomicrograph of an interfacial region of a cemented carbide blade piece and machinable non-cemented carbide, metallic piece incorporated in the fixed-cutter earth-boring bit depicted in FIG. 8.

FIG. 13 is a photomicrograph of an interfacial region 130 between a cemented carbide piece 132 forming a blade region 82 of the bit 80, and the machinable attachment region 134 of the bit 80 which includes tungsten particles 136 dispersed in the continuous bronze matrix 138.

It will be understood that the present description illustrates those aspects of the invention relevant to a clear understanding of the invention. Certain aspects that would be apparent to those of ordinary skill in the art and that, therefore, would not facilitate a better understanding of the invention have not been presented in order to simplify the present description. Although only a limited number of embodiments of the present invention are necessarily described herein, one of ordinary skill in the art will, upon considering the foregoing description, recognize that many modifications and variations of the invention may be employed. All such variations and modifications of the invention are intended to be covered by the foregoing description and the following claims.

We claim:

1. An article of manufacture comprising one of a fixed-cutter earth-boring bit body, a roller cone, and a part for an earth-boring bit, the article of manufacture comprising:

at least one cemented carbide piece;

at least one non-cemented carbide piece comprising at least one solid metallic component, wherein the at least one solid metallic component comprises threads adapted to attach the article of manufacture to a drill string; and a joining phase binding the at least one cemented carbide piece and the at least one non-cemented carbide piece into the article of manufacture, wherein the joining phase comprises a eutectic alloy material.

2. The article of manufacture of claim 1, wherein a volume of cemented carbide in the at least one cemented carbide piece is at least 5% of a total volume of the article of manufacture.

3. The article of manufacture of claim 1, wherein a volume of cemented carbide in the cemented carbide piece is at least 10% of a total volume of the article of manufacture.

4. The article of manufacture of claim 1, wherein the at least one cemented carbide piece comprises particles of at least one carbide of a metal selected from Groups IVB, VB, and VIB of the Periodic Table, dispersed in a binder comprising at least one of cobalt, a cobalt alloy, nickel, a nickel alloy, iron, and an iron alloy.

5. The article of manufacture of claim 4, wherein the binder of the at least one cemented carbide piece further comprises at least one additive selected from chromium, silicon, boron, aluminum, copper, ruthenium, and manganese.

6. The article of manufacture of claim 1, wherein the at least one cemented carbide piece comprises a hybrid cemented carbide.

7. The article of manufacture of claim 6, wherein a dispersed phase of the hybrid cemented carbide has a contiguity ratio no greater than 0.48.

8. The article of manufacture of claim 1, wherein the at least one non-cemented carbide piece comprises at least one of iron, an iron alloy, nickel, a nickel alloy, cobalt, a cobalt alloy, copper, a copper alloy, aluminum, an aluminum alloy, titanium, a titanium alloy, tungsten, and a tungsten alloy.

9. The article of manufacture of claim 1, wherein the eutectic alloy material comprises 55 weight percent nickel and 45 weight percent tungsten carbide.

10. The article of manufacture of claim 1, wherein the solid metallic component consists of one of iron, an iron alloy, nickel, a nickel alloy, cobalt, a cobalt alloy, copper, a copper alloy, aluminum, an aluminum alloy, titanium, a titanium alloy, tungsten, and a tungsten alloy.

11. An earth-boring article comprising one of a fixed-cutter earth-boring bit body, a roller cone, and a part for an earth-boring bit, comprising:

at least one cemented carbide piece;

at least one non-cemented carbide piece comprising a solid metallic component, wherein the at least one solid metallic component comprises threads adapted to attach the article of manufacture to a drill string; and a joining phase binding the at least one cemented carbide piece and the at least one non-cemented carbide piece into the earth-boring article, wherein the joining phase comprises a eutectic alloy material.

12. The earth-boring article of claim 11, wherein a volume of cemented carbide in the at least one cemented carbide piece is at least 5% of a total volume of the earth-boring article.

13. The earth-boring article of claim 11, wherein a volume of cemented carbide in the at least one cemented carbide piece is at least 10% of a total volume of the earth-boring article.

14. The earth-boring article of claim 11, wherein the at least one cemented carbide piece comprises particles of at least one carbide of a metal selected from Groups IVB, VB, and VIB of the Periodic Table, dispersed in a binder comprising at least one of cobalt, a cobalt alloy, nickel, a nickel alloy, iron, and an iron alloy.

15. The earth-boring article of claim 14, wherein the binder of the at least one cemented carbide piece further comprises at least one additive selected from chromium, silicon, boron, aluminum, copper, ruthenium, and manganese.

16. The earth-boring article of claim 11, wherein the at least one cemented carbide piece comprises a hybrid cemented carbide.

17. The earth-boring article of claim 16, wherein a dispersed phase of the hybrid cemented carbide has a contiguity ratio no greater than 0.48.

18. The earth-boring article of claim 11, wherein the at least one non-cemented carbide piece comprises at least one of iron, an iron alloy, nickel, a nickel alloy, cobalt, a cobalt alloy, copper, a copper alloy, aluminum, an aluminum alloy, titanium, a titanium alloy, tungsten, and a tungsten alloy.

19. The earth-boring article of claim 11, wherein the eutectic alloy material comprises 55 weight percent nickel and 45 weight percent tungsten carbide.

20. The earth-boring article of claim 11, wherein the solid metallic component consists of one of iron, an iron alloy, nickel, a nickel alloy, cobalt, a cobalt alloy, copper, a copper alloy, aluminum, an aluminum alloy, titanium, a titanium alloy, tungsten, and a tungsten alloy.

21. An earth-boring article, comprising:

at least one cemented carbide piece, wherein a volume of cemented carbide in the at least one cemented carbide piece is at least 5% of a total volume of the earth-boring article;

at least one non-cemented carbide piece comprising a metallic material, the at least one non-cemented carbide piece comprising threads adapted to attach the earth-boring article to a drill string; and a joining phase binding the at least one cemented carbide piece and the at least one non-cemented carbide piece into the earth-boring article, the joining phase comprising a eutectic alloy material.

22. The earth-boring article of claim 21, wherein a volume of cemented carbide in the at least one cemented carbide piece is at least 10% of a total volume of the article of manufacture.

23. The earth-boring article of claim 21, wherein the at least one cemented carbide piece comprises particles of at least one carbide of a metal selected from Groups IVB, VB, and VIB of the Periodic Table, dispersed in a binder comprising at least one of cobalt, a cobalt alloy, nickel, a nickel alloy, iron, and an iron alloy.

24. The earth-boring article of claim 23, wherein the binder of the at least one cemented carbide piece further comprises at least one additive selected from chromium, silicon, boron, aluminum, copper, ruthenium, and manganese.

25. The earth-boring article of claim 21, wherein the at least one cemented carbide piece comprises a hybrid cemented carbide.

26. The earth-boring article of claim 25, wherein a dispersed phase of the hybrid cemented carbide has a contiguity ratio no greater than 0.48.

27. The earth-boring article of claim 21, wherein the at least one non-cemented carbide piece comprises at least one of iron, an iron alloy, nickel, a nickel alloy, cobalt, a cobalt alloy, copper, a copper alloy, aluminum, an aluminum alloy, titanium, a titanium alloy, tungsten, and a tungsten alloy.

28. The earth-boring article of claim 21, wherein the eutectic alloy material comprises 55 weight percent nickel and 45 weight percent tungsten carbide.

29. The earth-boring article of claim 21, wherein earth-boring article is one of a fixed-cutter earth-boring bit body, a roller cone, and a part for an earth-boring bit.

30. An earth-boring article, comprising:

at least one cemented carbide piece, wherein a volume of cemented carbide in the at least one cemented carbide piece is at least 5% of a total volume of the earth-boring article;

at least one non-cemented carbide piece comprising at least one of a metal and a metallic alloy, wherein the at least one non-cemented carbide piece comprises threads adapted to attach the earth-boring article to a drill string; and a joining phase binding the at least one cemented carbide piece and the at least one non-cemented carbide piece into the earth-boring article, the joining phase comprising a eutectic alloy material consisting essentially of 55 weight percent nickel, 45 weight percent tungsten carbide, and incidental impurities.

31. The earth-boring article of claim 30, wherein a volume of cemented carbide in the at least one cemented carbide piece is at least 10% of a total volume of the article of manufacture.

32. The earth-boring article of claim 30, comprising at least two of the cemented carbide pieces, wherein the joining phase binds each of the cemented carbide pieces into the earth-boring article.

33. The earth-boring article of claim 30, wherein the at least one cemented carbide piece comprises particles of at least one carbide of a metal selected from Groups IVB, VB, and VIB of the Periodic Table, dispersed in a binder comprising at least one of cobalt, a cobalt alloy, nickel, a nickel alloy, iron, and an iron alloy.

34. The earth-boring article of claim 33, wherein the binder of the at least one cemented carbide piece further comprises at least one additive selected from chromium, silicon, boron, aluminum, copper, ruthenium, and manganese.

35. The earth-boring article of claim 30, wherein the earth-boring article is a fixed-cutter earth-boring bit comprising a blade region, and wherein the at least one cemented carbide piece is at least a portion of the blade region.

36. The earth-boring article of claim 30, wherein the at least one cemented carbide piece comprises a hybrid cemented carbide.

37. The earth-boring article of claim 36, wherein a dispersed phase of the hybrid cemented carbide has a contiguity ratio no greater than 0.48.

38. The earth-boring article of claim 30, wherein the at least one non-cemented carbide piece comprises at least one of iron, an iron alloy, nickel, a nickel alloy, cobalt, a cobalt alloy, copper, a copper alloy, aluminum, an aluminum alloy, titanium, a titanium alloy, tungsten, and a tungsten alloy.

39. The earth-boring article of claim 30, wherein earth-boring article is selected from a fixed-cutter earth-boring bit, a fixed-cutter earth-boring bit body, a roller cone bit, and a roller cone.

* * * * *